US011717062B2

(12) United States Patent
Cowdery et al.

(10) Patent No.: US 11,717,062 B2
(45) Date of Patent: Aug. 8, 2023

(54) INTERLOCKING ZIPPER PULL TABS AND FASTENING SYSTEM

(71) Applicant: Travel Caddy, Inc., Franklin Park, IL (US)

(72) Inventors: Henry J. Cowdery, Schaumburg, IL (US); Donald E. Godshaw, Wilmette, IL (US); Du Hai, Uncasville, CT (US)

(73) Assignee: Travel Caddy, Inc., Franklin Park, IL (US)

( * ) Notice: Subject to any disclaimer, the term of this patent is extended or adjusted under 35 U.S.C. 154(b) by 0 days.

(21) Appl. No.: 17/517,865

(22) Filed: Nov. 3, 2021

(65) Prior Publication Data

US 2022/0053890 A1 Feb. 24, 2022

Related U.S. Application Data

(63) Continuation of application No. 16/706,700, filed on Dec. 7, 2019, now Pat. No. 11,185,134, which is a (Continued)

(51) Int. Cl.
*A44B 19/24* (2006.01)
*A44B 19/36* (2006.01)

(Continued)

(52) U.S. Cl.
CPC ..... *A44B 19/30* (2013.01); *A44B 13/02* (2013.01); *A44B 19/26* (2013.01); *A44B 19/262* (2013.01);

(Continued)

(58) Field of Classification Search
CPC ..... A44B 19/36; A44B 19/262; A44B 19/301; A44B 19/30; Y10T 24/2598; Y10T 24/2509; Y10T 24/2586; Y10T 70/5053
See application file for complete search history.

(56) References Cited

U.S. PATENT DOCUMENTS 81,026 A 8/1868 Sparks
82,644 A 11/1868 Sanford (Continued)

FOREIGN PATENT DOCUMENTS

DE 202009006894 U1 1/2010
EP 2404521 B1 11/2012

(Continued)

OTHER PUBLICATIONS

Notification of Transmittal of the International Search Report and Written Opinion of the International Searching Authority, or the Declaration from the International Bureau of WIPO for International Application No. PCT/US2016/042794, dated Dec. 8, 2016, pp. 1-22.

(Continued)

*Primary Examiner* — Robert Sandy
*Assistant Examiner* — Michael S Lee
(74) *Attorney, Agent, or Firm* — Nancy R. Gamburd; Gamburd Law Group LLC

(57) ABSTRACT

A fastening system for a zipper is disclosed which includes locking or interlocking first and second zipper pull tabs. A first zipper pull tab comprises a first base, a hook extending from the first base, and a movable gate coupled to the first base. A second zipper pull tab comprises a second base, a cover coupled to the second base, and a post extending between the second base and the cover. For interlocking, the movable gate and hook are further coupled around the post to provide the interlocking configuration of the first and second zipper pull tabs. The first zipper pull tab may be utilized separately from the second zipper pull tab, such as to lock to a coupling ring or another component of a carrying bag.

20 Claims, 27 Drawing Sheets

Related U.S. Application Data continuation of application No. 15/212,823, filed on Jul. 18, 2016, now Pat. No. 10,499,712.

(60) Provisional application No. 62/194,929, filed on Jul. 21, 2015.

(51) Int. Cl.

| | |
|---|---|
| ***A44B 13/02*** | (2006.01) |
| ***A44B 19/30*** | (2006.01) |
| ***A44B 19/26*** | (2006.01) |
| ***A45C 13/10*** | (2006.01) |
| *A43C 13/10* | (2006.01) |

(52) U.S. Cl.

CPC ..... *A44B 19/301* (2013.01); *A45C 13/103* (2013.01); *Y10T 24/2509* (2015.01); *Y10T 24/2586* (2015.01); *Y10T 70/5053* (2015.04)

(56) References Cited

U.S. PATENT DOCUMENTS

| | | | | |
|---|---|---|---|---|
| 124,832 | A | 3/1872 | Leigh | |
| 238,209 | A | 3/1881 | Bragg | |
| 2,845,297 | A | 7/1958 | Doop | |
| 4,350,375 | A | 9/1982 | Bako | |
| 4,395,891 | A | 8/1983 | Remington | |
| 4,873,750 | A | 10/1989 | Tracy | |
| 4,920,615 | A | 5/1990 | Aoki et al. | |
| 4,928,363 | A | 5/1990 | Easton | |
| 4,976,015 | A | 12/1990 | Ishii | |
| 4,997,222 | A | 3/1991 | Reed | |
| 5,093,966 | A | 3/1992 | Yuki et al. | |
| 5,100,191 | A | 3/1992 | Detrick et al. | |
| 5,347,692 | A * | 9/1994 | Ebata | B29C 45/14 24/429 |
| 5,535,491 | A | 7/1996 | Allport | |
| 5,586,368 | A | 12/1996 | Nelson | |
| 5,875,525 | A | 3/1999 | Lee et al. | |
| 5,901,421 | A | 5/1999 | Lee et al. | |
| 6,035,497 | A | 3/2000 | Jackson | |
| 6,314,624 | B1 | 11/2001 | Lin | |
| 6,314,625 | B1 | 11/2001 | Ikeda | |
| 6,494,512 | B1 | 12/2002 | Cada et al. | |
| 6,536,084 | B2 | 3/2003 | Davis | |
| 6,581,254 | B1 | 6/2003 | Tang | |
| 6,694,574 | B1 | 2/2004 | Sheng | |
| 6,804,867 | B2 | 10/2004 | Oda et al. | |
| 7,020,937 | B2 | 4/2006 | Nakatsuka et al. | |
| 7,047,602 | B2 | 5/2006 | Wang | |
| 7,454,819 | B2 | 11/2008 | Wu | |
| 7,603,753 | B2 | 10/2009 | Baker | |
| 7,979,964 | B2 | 7/2011 | Jans | |
| 8,082,635 | B2 | 12/2011 | Leveau | |
| 8,453,301 | B1 | 6/2013 | McCoy | |
| 8,528,115 | B2 | 9/2013 | Damon et al. | |
| 8,661,861 | B2 | 3/2014 | Lai | |
| 8,677,574 | B1 | 3/2014 | Thiessen et al. | |
| 2005/0035605 | A1 | 2/2005 | Vanderwater-Piercy | |
| 2005/0257351 | A1 | 11/2005 | Pitts et al. | |
| 2008/0083100 | A1 | 4/2008 | Beed | |
| 2008/0222859 | A1 | 9/2008 | Chepurny et al. | |
| 2009/0106951 | A1 | 4/2009 | Edwards et al. | |
| 2012/0169076 | A1 | 7/2012 | Brake et al. | |
| 2013/0299540 | A1 * | 11/2013 | Avganim | E05B 73/0005 224/600 |
| 2014/0069757 | A1 * | 3/2014 | Schlipper | A44B 19/301 24/386 |
| 2015/0082585 | A1 | 3/2015 | Mayberry | |
| 2017/0156453 | A1 | 6/2017 | Burke et al. | |
| 2018/0332940 | A1 * | 11/2018 | Ponti | A45C 5/03 |

FOREIGN PATENT DOCUMENTS

| | | | |
|---|---|---|---|
| WO | WO2012103200 | A2 | 8/2012 |
| WO | WO2015026231 | A1 | 2/2015 |

OTHER PUBLICATIONS

European Patent Office Supplementary Search Report and European Search Opinion, European Patent Application No. 16828365.3, dated Mar. 15, 2019, pp. 1-16.

Australia Examination Report No. 1 For Standard Patent Application, Australia Patent Application No. 2106296619, dated Aug. 3, 2017, pp. 1-3.

* cited by examiner

INTERLOCKING ZIPPER PULL TABS AND FASTENING SYSTEM

CROSS-REFERENCE TO RELATED APPLICATIONS

This application is a continuation of and claims priority to and the benefit of U.S. patent application Ser. No. 16/706,700, filed Dec. 7, 2019, inventors Henry J. Cowdery et al., titled "Interlocking Zipper Pull Tabs and Fastening System", which is a continuation of and claims priority to and the benefit of U.S. patent application Ser. No. 15/212,823, filed Jul. 18, 2016 and issued Dec. 10, 2019 as U.S. Pat. No. 10,499,712, inventors Henry J. Cowdery et al., titled "Interlocking Zipper Pull Tabs and Fastening System", which is a nonprovisional of and claims priority to and the benefit of U.S. Provisional Patent Application No. 62/194,929, filed Jul. 21, 2015, inventors Henry J. Cowdery et al., titled "Interlocking Zipper Pull Tabs and Fastening System", which are commonly assigned herewith, incorporated herein by reference with the same full force and effect as if set forth in their entireties herein, and with priority claimed for all commonly disclosed subject matter.

FIELD OF THE INVENTION

The present invention generally relates to zip fasteners with security features, and more particularly, relates to interlocking and locking zipper pull tabs and fastening systems for locking, unlocking and opening zip fasteners.

BACKGROUND OF THE INVENTION

Locking zip fasteners, in the prior art, typically involve use of a combination or key lock or shackle to lock two zipper sliders together, typically to lock a zipped compartment or pocket, for example. While effective for suitcases during travel, such use of a combination or key lock for locking zip fasteners is largely impractical and unsuitable for other types of carrying bags, such as purses, backpacks, messenger bags, and briefcases. These types of carrying bags may be utilized every day, requiring prompt and ready access to zipped pockets and compartments to retrieve contents, such as keys and wallets, making use of such combination or key locks highly undesirable. In addition, there are aesthetic and fashion concerns for these types of carrying bags, also rendering use of combination or key locks highly unsatisfactory.

Other types of locking zip fasteners are also typically unsuitable for these types of carrying bags, from both functional and aesthetic/fashion points of view. For example, the mating locking zipper tabs of U.S. Patent Application Publication No. 2014/0069757 are interlocked orthogonally (perpendicular) to the zipper and protrude or extend away from the carrying bag. These interlocked, mating zipper tabs can readily snag on other items, such as clothing, and often come apart and fail as a locking mechanism under conditions of actual use, such as when jostled or bumped. As these mating zipper tabs are typically asymmetrical, have protruding mating structures for locking, and do not align with the direction of the zipper itself, they are also typically unsuitable for carrying bags which have fashion, aesthetic and design objectives, such as purses and briefcases.

Similar functional and aesthetic concerns arise for other locking zipper structures, such as those of U.S. Patent Application Publication No. 2009/0106951 and U.S. Patent Application Publication No. 2005/0257351, which are also unsuitable for carrying bags which have fashion, aesthetic and design objectives, such as purses and briefcases.

Accordingly, a need remains for locking zipper pull tabs which may be readily implemented, and which are suitable for carrying bags which have fashion, aesthetic and design objectives, such as purses and briefcases. Such locking zipper pull tabs should nonetheless require multiple, distinct and different movements to open the locking zipper pull tabs, to avoid inadvertent or easy opening of the locking zipper pull tabs, and thereby provided additional locking security.

SUMMARY OF THE INVENTION

The exemplary embodiments provide interlocking and/or locking zipper pull tabs. The exemplary embodiments provide for increased security of a fastener, requiring several different and distinct movements to open the exemplary or representative interlocking and/or locking zipper pull tabs. This also serves to decrease the concerns of a traveler or commuter, for example, knowing that a would-be pickpocket or other thief cannot quickly and surreptitiously undo and open the interlocking and/or locking zipper pull tabs, such as to quickly steal contents of a purse, briefcase, shoulder bag or other carrying bag. The exemplary or representative interlocking and/or locking zipper pull tab fasteners may also be implemented aesthetically, with designs which do not look or feel utilitarian but which nonetheless have superior attachment and security functionality.

The exemplary or representative interlocking and/or locking zipper pull tab fasteners are especially useful for providing added security for various carrying bags, such as purses, briefcases, backpacks, suitcases, and other luggage. Such carrying bags typically have pockets and compartments with zip fasteners which, unfortunately, may be opened inadvertently or without authorization, with unwanted access to the contents of the pockets or compartments. The representative embodiments of the first and second interlocking and/or locking zipper pull tabs may be utilized in these environments, including substituting for zipper pulls on existing products without any significant retrofitting. In addition, the first interlocking and/or locking zipper pull tab fastener may be utilized in a wide variety of contexts, such as for locking a single zipper slider to a D-ring or another object, for example and without limitation.

A fastening system for a zipper is disclosed, with the zipper having one or more zipper sliders. A representative fastening system comprises: a first zipper pull tab coupleable to a first zipper slider and a second zipper pull tab coupleable to a second zipper slider, with the first zipper pull tab comprising: a first base; a hook extending from the first base; and a movable gate coupled to the first base, the movable gate and hook forming a first interior region of the first zipper pull tab; and with the second zipper pull tab comprising: a second base; a cover coupled to the second base; and a post extending between the second base and the cover, the cover and post forming a second interior region of the second zipper pull tab.

Another representative fastening system comprises: a first zipper pull tab coupleable to a first zipper slider, the first zipper pull tab comprising: a first base; a hook integrally formed with and extending from the first base, the hook comprising an elongated rectilinear portion and a C-shaped curvature terminating in a hook end; and a movable gate having a first gate end and a second gate end, the movable gate pivotably coupled at the second gate end to the first base, the movable gate and hook forming a first interior region of the first zipper pull tab, the movable gate extending from the first base substantially parallel to the elongated rectilinear portion of the hook; wherein at least one of the hook end and first gate end further comprises a protruding tab structure and at least one of the first gate end and hook end respectively further comprises a mating recess.

In a representative embodiment, the fastening system may further comprise: a second zipper pull tab coupleable to a second zipper slider, the second zipper pull tab comprising: a second base; a cover coupled to the second base; and a post extending between the second base and the cover, the cover and post forming a second interior region of the second zipper pull tab.

In a representative embodiment, the movable gate and hook are further coupled around the post and within the second interior region to provide an interlocking configuration of the first and second zipper pull tabs. For such an embodiment, the movable gate and hook are further arranged or disposed between the cover and the second base within the second interior region. For such an embodiment, the movable gate and hook are further arranged or disposed spaced apart from the coupling of the second base and the cover and the movable gate is freely movable in a first interlocking configuration of the first and second zipper pull tabs. For another such embodiment, the movable gate and hook are further arranged or disposed adjacent or abutting the coupling of the second base and the cover, and movement of the movable gate is at least partially blocked by the post in a second interlocking configuration of the first and second zipper pull tabs. In a representative embodiment, a minimum diameter or lateral dimension of the post is greater than the allowable amount of movement of the movable gate when at least partially blocked by the post.

In a representative embodiment, the first base is further abutting and overlying the second base. In another representative embodiment, the first base and the second base are further abutting, overlying and substantially parallel to a zipper coupled to the first and second zipper sliders.

In a representative embodiment, the gate further comprises a first gate end abutting an end of the hook to form the first interior region within the first zipper pull tab. Also in a representative embodiment, wherein at least one of the hook end and first gate end further comprises a protruding tab structure and at least one of the first gate end and hook end respectively further comprises a mating recess.

In another representative embodiment, the cover has a first distal end and a first proximal end, wherein the second base has a second distal end and a second proximal end, and wherein the first proximal end of the cover is coupled to or integrally formed with the second proximal end of the second base. For such an embodiment, the post extends from at or near the first distal end of the cover to form a second interior region within the second zipper pull tab. In a representative embodiment, the first proximal end of the cover and the second proximal end of the second base further comprise a second interior region face opposite the post. In a representative embodiment, the second proximal end has a first thickness and the second distal end has a second thickness greater than the first thickness. For example and without limitation, a ratio of the second thickness to the first thickness is between 4:1 to 1.25:1.

In another representative embodiment, wherein the first base has a substantially flat form factor and a substantially uniform first thickness.

In another representative embodiment, the first zipper pull tab further comprises a first C-shaped coupling integrally formed with the base for coupling to the first zipper slider, and wherein the second zipper pull tab further comprises a second C-shaped coupling for coupling to the second zipper slider. For such an embodiment, the first C-shaped coupling has a thickness tapering from a first thickness at the first base to a second thickness at an end of the first base, the first thickness greater than the second thickness. For example and without limitation, a ratio of the first thickness to the second thickness is between 4:1 to 2:1.

Also for such an embodiment, the second C-shaped coupling has a thickness tapering from a first thickness at the coupling of the second base and cover to a second thickness at an end of the second zipper pull tab, the first thickness greater than the second thickness. For example and without limitation, a ratio of the first thickness to the second thickness is between 4:1 to 2:1.

In another representative embodiment, the hook has a thickness tapering from first thickness at the first base to a second thickness at an end of the first zipper pull tab, the first thickness greater than the second thickness. For example and without limitation, a ratio of the first thickness to the second thickness is between 4:1 to 2:1.

In a representative embodiment, the second interior region has a form factor for insertion of the hook within the second interior region in an interlocked configuration. For such an embodiment, each of the first zipper pull tab and the second zipper pull tab have a substantially flat form factor.

A first zipper pull tab coupleable to a zipper slider is also disclosed. In a representative embodiment, the zipper pull tab comprises: a base; a hook extending from the base; and a movable gate coupled to the base, the movable gate and hook forming a first interior region of the first zipper pull tab.

In another representative embodiment, the (first) zipper pull tab may comprise: a base; a hook integrally formed with and extending from the first base, the hook terminating in a hook end; and a movable gate having a first gate end and a second gate end, the movable gate pivotably coupled at the second gate end to the base, the movable gate and hook forming a first interior region of the zipper pull tab; wherein at least one of the hook end and first gate end further comprises a protruding tab structure and at least one of the first gate end and hook end respectively further comprises a mating recess.

In another representative embodiment, the (first) zipper pull tab may comprise: a base having a substantially flat form factor and a substantially uniform first thickness; a hook integrally formed with and extending from the base, the hook comprising an elongated rectilinear portion and a C-shaped curvature terminating in a hook end; and a movable gate having a first gate end and a second gate end, the movable gate pivotably coupled at the second gate end to the base, the movable gate and hook forming a first interior region of the zipper pull tab, the movable gate extending from the base substantially parallel to the elongated rectilinear portion of the hook.

In another representative embodiment, the (first) zipper pull tab may comprise: a base having a substantially flat form factor and a substantially uniform first thickness; a hook integrally formed with and extending from the base, the hook comprising an elongated rectilinear portion and a C-shaped curvature terminating in a hook end; and a movable gate having a first gate end and a second gate end, the movable gate pivotably coupled at the second gate end to the base, the movable gate and hook forming a first interior region of the zipper pull tab, the movable gate extending from the base substantially parallel to the elongated rectilinear portion of the hook; wherein at least one of the first hook end and first gate end further comprises a protruding tab structure and at least one of the first gate end and first hook end respectively further comprises a mating recess; and wherein the zipper pull tab has a substantially flat form factor.

For such an embodiment, in addition to interlocking with a second zipper pull tab, the hook may be further coupled to a D-ring or other coupling structure of a carrying bag.

A second zipper pull tab coupleable to a zipper slider is also disclosed. In a representative embodiment, the zipper pull tab comprises: a base; a cover coupled to the base; and a post extending between the base and the cover, the cover and post forming an interior region of the zipper pull tab.

A fastening system for a carrying bag is also disclosed. In a representative embodiment, the fastening system comprises a zipper, a first zipper pull tab, and a second zipper pull tab; with the zipper comprising: a zipper tape having a plurality of zipper teeth; a first zipper slider; and a second zipper slider; with the first zipper pull tab: comprising: a first base having a first coupling coupled to the first zipper slider; a hook extending from the first base; and a movable gate coupled to the first base, the movable gate and hook forming a first interior region of the first zipper pull tab; and with the second zipper pull tab comprising: a second coupling coupled to the second zipper slider; a second base: a cover coupled to the second base: and a post extending between the second base and the cover, the cover and post forming a second interior region of the second zipper pull tab.

A carrying bag may have such a fastening system of the representative embodiments. For example and without limitation, a zipper may be coupled to the carrying bag, or vice-versa.

Numerous other advantages and features of the present disclosure will become readily apparent from the following detailed description of the subject matter described in this specification and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, wherein like reference numerals are used to identify identical components in the various views, and wherein reference numerals with alphabetic characters and/or numeric subscripts are utilized to identify parts or subparts of a component or additional types, instantiations or variations of a selected component embodiment in the various views, as further indicated by textual context, in which.

DETAILED DESCRIPTION OF REPRESENTATIVE EMBODIMENTS

Figure 1:
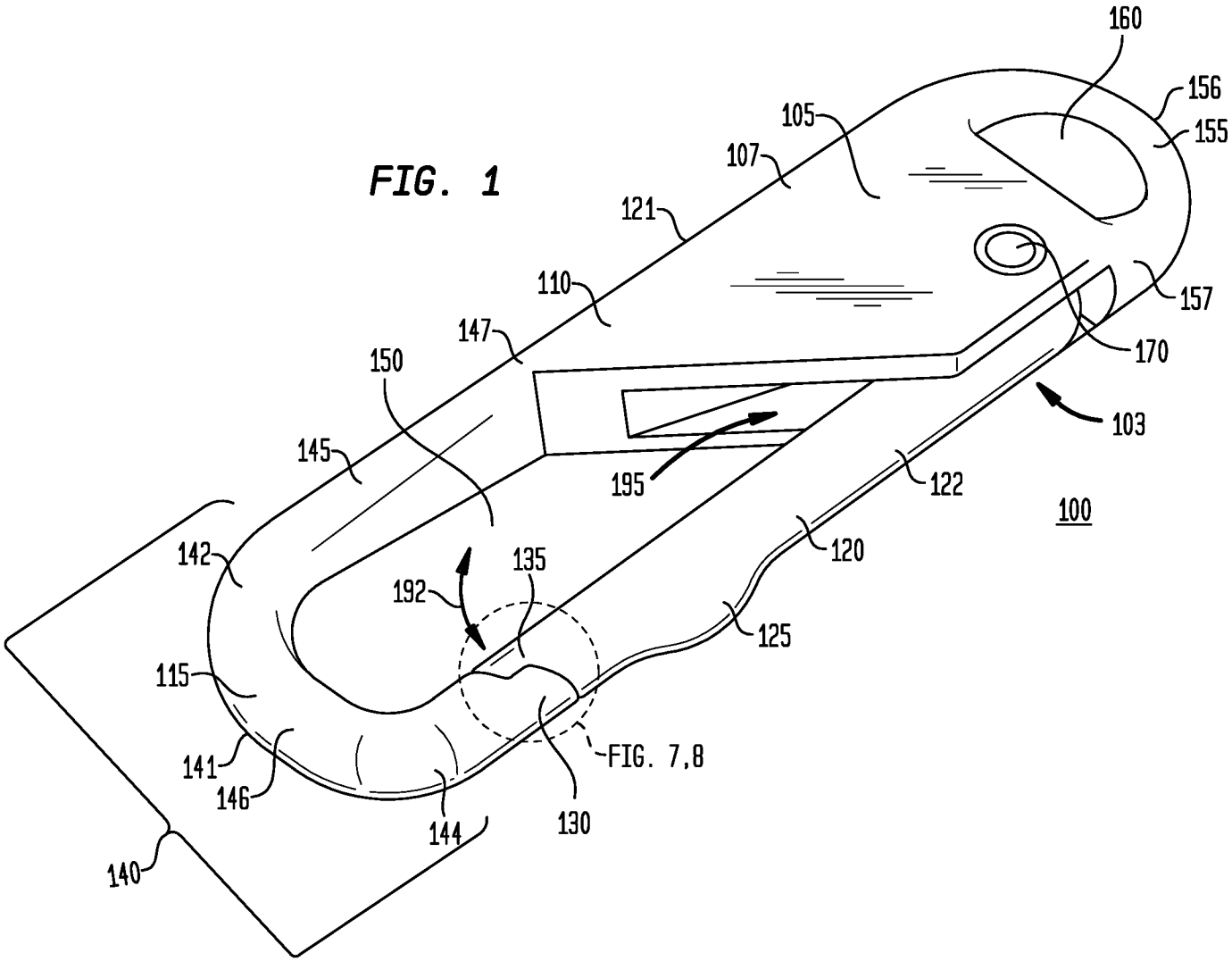
FIG. 1 is a diagram illustrating an isometric view of an exemplary or representative first zipper pull tab embodiment in a closed configuration.

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

The first and second zipper pull tabs 100, 200 are especially useful for providing added security for various carrying bags, such as purses, briefcases, backpacks, suitcases, and other luggage. Such carrying bags typically have pockets and compartments with zip fasteners which, unfortunately, may be opened inadvertently or without authorization, with unwanted access to the contents of the pockets or compartments. The representative embodiments of the first and second zipper pull tabs 100, 200 may be utilized in these environments, including substituting for zipper pulls on existing products without any significant retrofitting. In addition, the first zipper pull tab 100 may be utilized in a wide variety of contexts, such as for locking a single zipper slider to a D-ring, another fastener, or another object, for example and without limitation.

Accordingly, the exemplary or representative zipper pull tab fasteners may be referred to as "interlocking", such as for the first fastening system embodiment in which the first and second zipper pull tab fasteners 100, 200 are coupled to each other (i.e., are interlocked), and they may be equivalently referred to more generally as "locking", such as for the second and third fastening system embodiments, in which the exemplary or representative first zipper pull tab fastener 100 is utilized to lock to another object, such as a coupling ring 305, 315.

Figure 2:
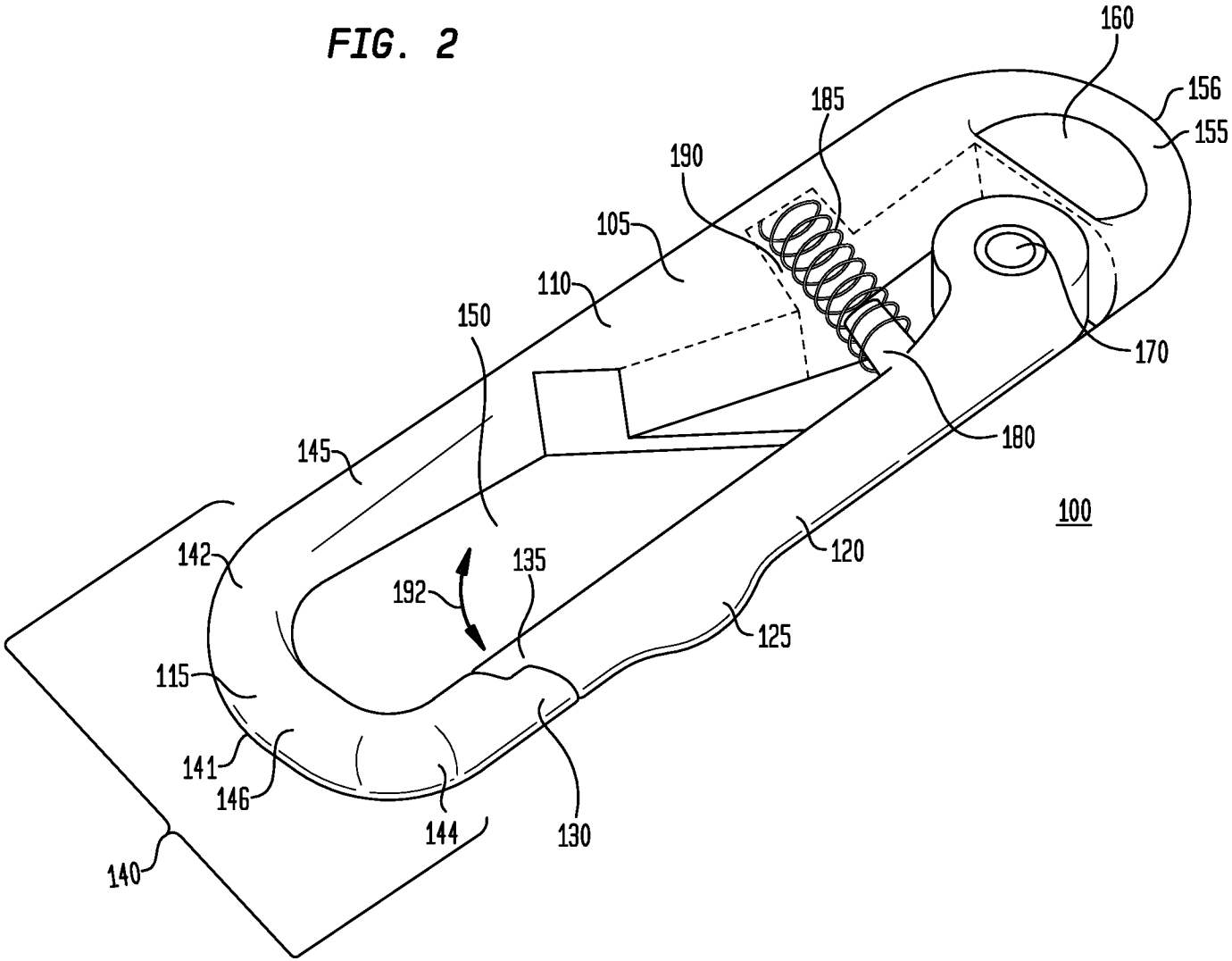
FIG. 2 is a diagram illustrating an isometric cut-away view of an exemplary or representative first zipper pull tab embodiment in a closed configuration.
Figure 3:
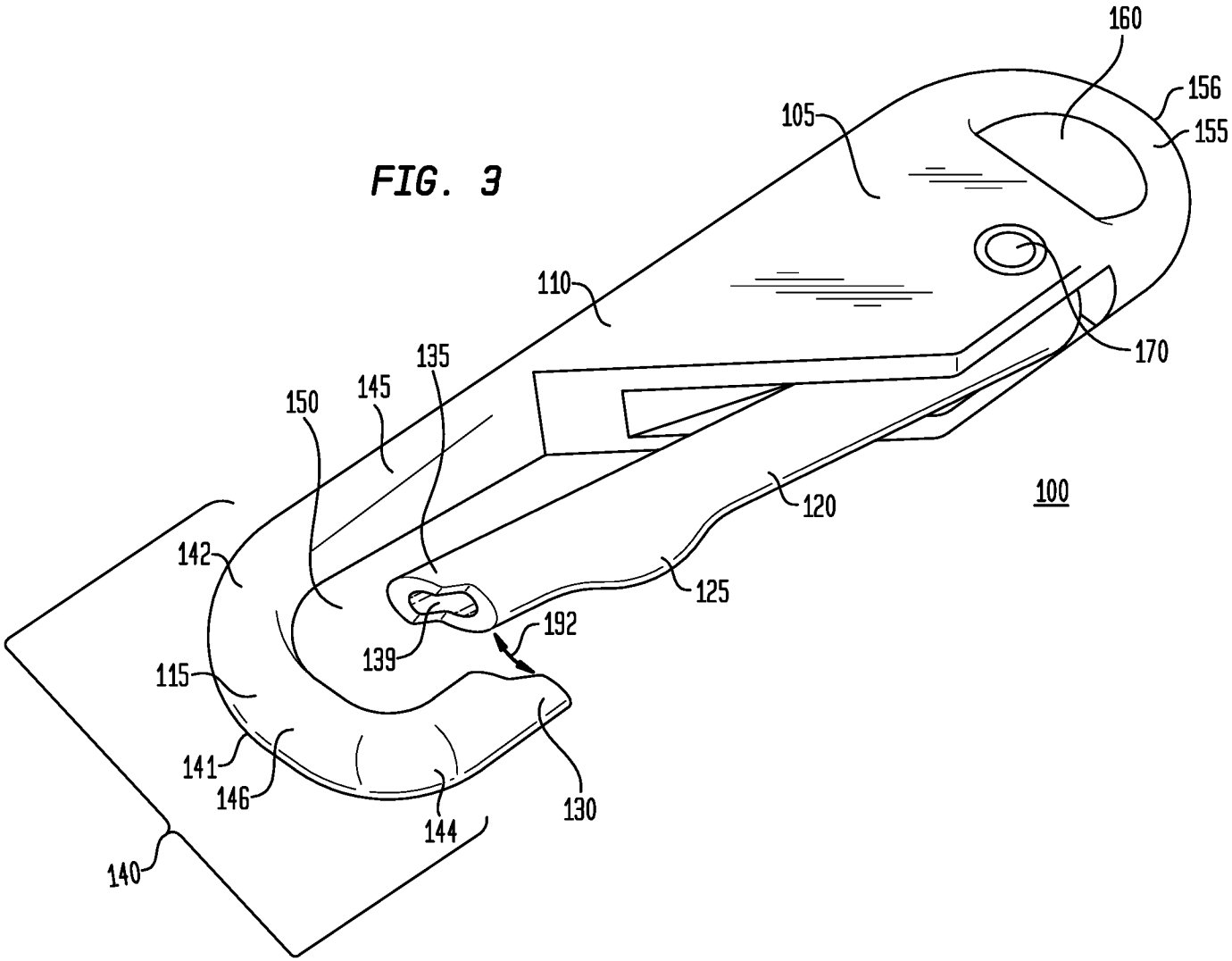
FIG. 3 is a diagram illustrating an isometric view of an exemplary or representative first zipper pull tab embodiment in an open configuration.
Figure 4:
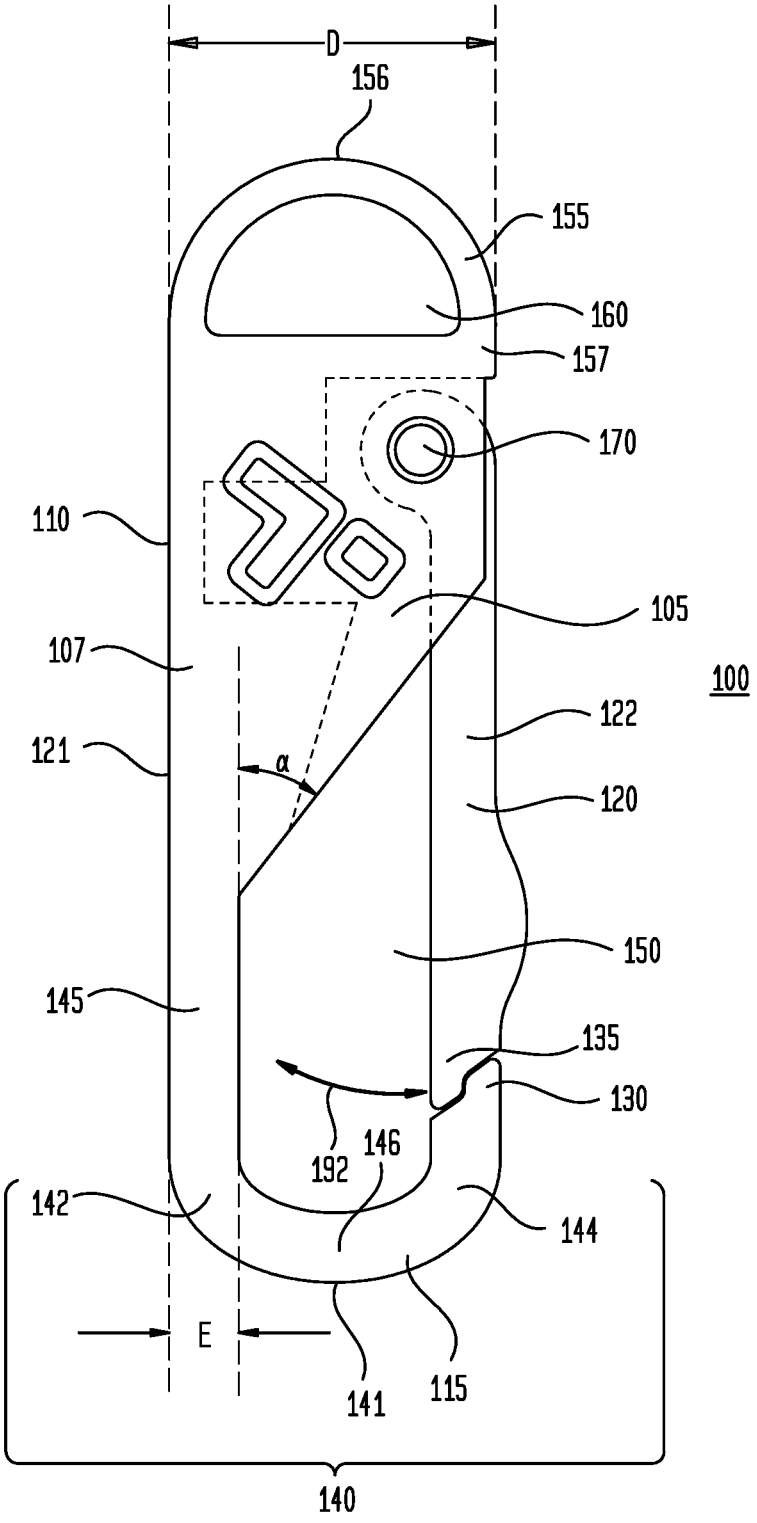
FIG. 4 is a diagram illustrating a plan view of a first, top side of an exemplary or representative first zipper pull tab embodiment in a closed configuration.
Figure 5:
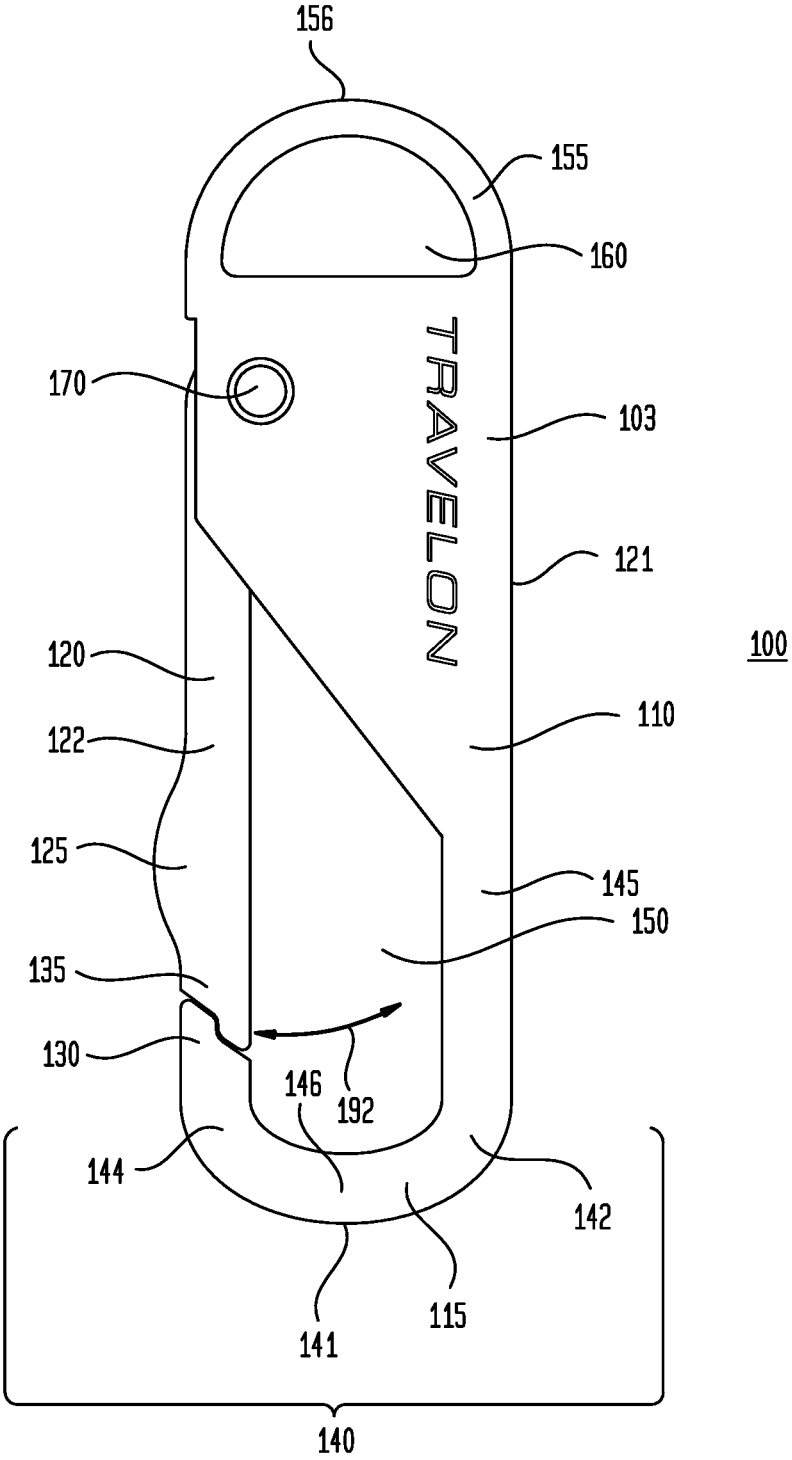
FIG. 5 is a diagram illustrating a plan view of a second, bottom side of an exemplary or representative first zipper pull tab embodiment in a closed configuration.
Figure 6:
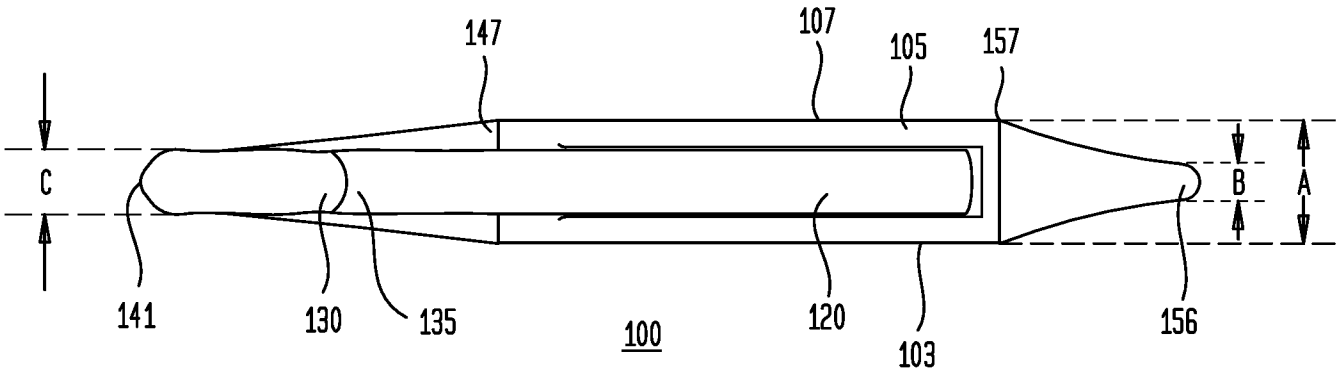
FIG. 6 is a diagram illustrating a plan view of a lateral side of an exemplary or representative first zipper pull tab embodiment in a closed configuration.
Figure 7:
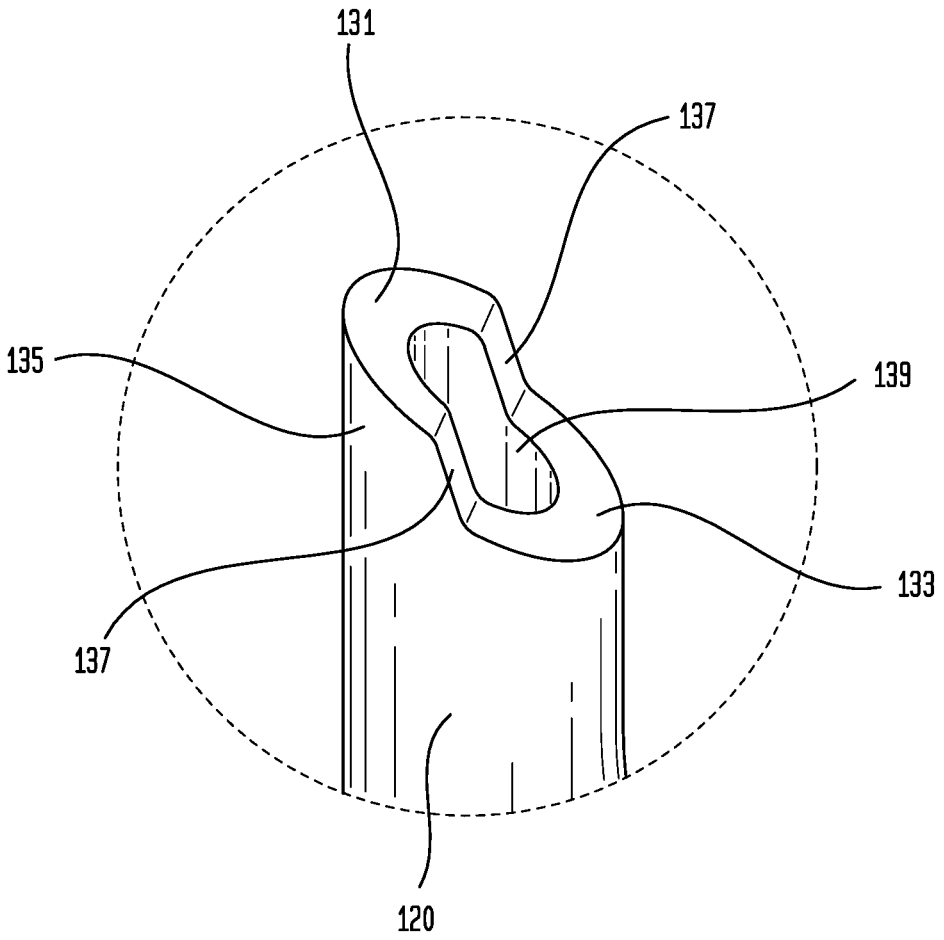
FIG. 7 is a diagram illustrating an enlarged isometric view of a first end of an exemplary or representative gate of an exemplary or representative first zipper pull tab embodiment.
Figure 8:
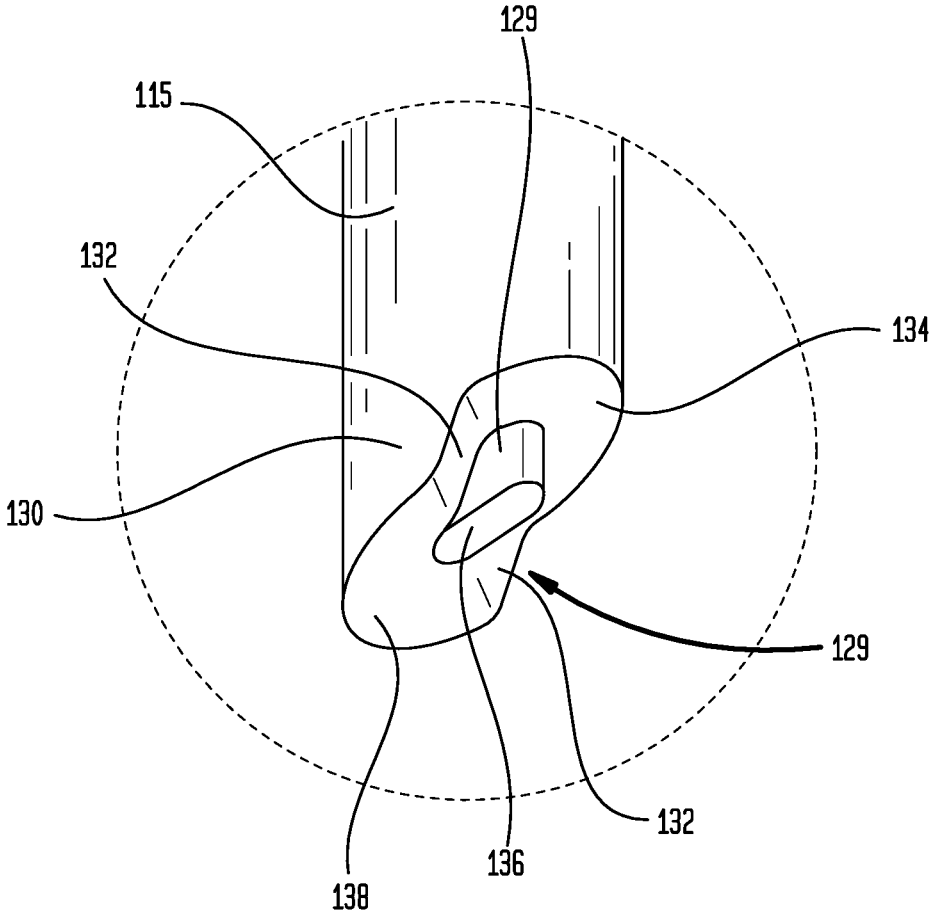
FIG. 8 is a diagram illustrating an enlarged isometric view of an end of an exemplary or representative hook of a body of an exemplary or representative first zipper pull tab embodiment.
Figure 9:
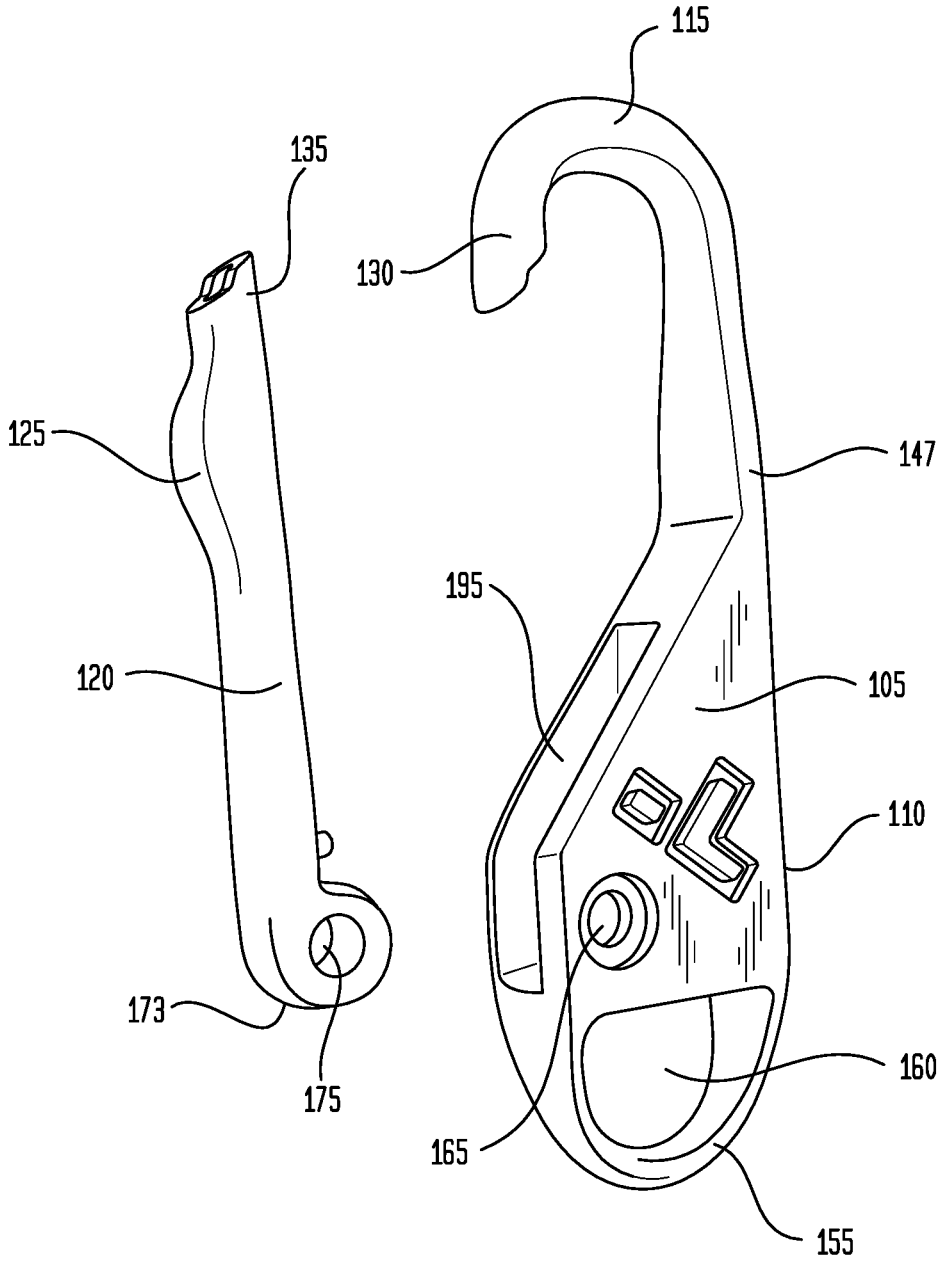
FIG. 9 is a diagram illustrating an isometric view of exemplary or representative body and gate components in a disassembled state of an exemplary or representative first zipper pull tab embodiment.

FIG. 1 is a diagram illustrating an isometric view of an exemplary or representative first zipper pull tab 100 embodiment in a closed configuration. FIG. 2 is a diagram illustrating an isometric cut-away view of an exemplary or representative first zipper pull tab 100 embodiment in a closed configuration. FIG. 3 is a diagram illustrating an isometric view of an exemplary or representative first zipper pull tab 100 embodiment in an open configuration. FIG. 4 is a diagram illustrating a plan view of a first, top side of an exemplary or representative first zipper pull tab 100 embodiment in a closed configuration. FIG. 5 is a diagram illustrating a plan view of a second, bottom side of an exemplary or representative first zipper pull tab 100 embodiment in a closed configuration. FIG. 6 is a diagram illustrating a plan view of a lateral side of an exemplary or representative first zipper pull tab 100 embodiment in a closed configuration. FIG. 7 is a diagram illustrating an enlarged isometric view of a first end 135 of an exemplary or representative gate 120 of an exemplary or representative first zipper pull tab 100 embodiment. FIG. 8 is a diagram illustrating an enlarged isometric view of an end 130 of an exemplary or representative hook 115 of a body 110 of an exemplary or representative first zipper pull tab 100 embodiment. FIG. 9 is a diagram illustrating an isometric view of exemplary or representative body 110 and gate 120 components in a disassembled state of an exemplary or representative first zipper pull tab 100 embodiment. The various Figures also illustrate optional stylized logos and names which should not be confused with structural components, namely, the "T" logo and "Travelon" name and logo, both of which may be applied as an option to the first and/or second zipper pull tabs 100, 200.

Figure 16:
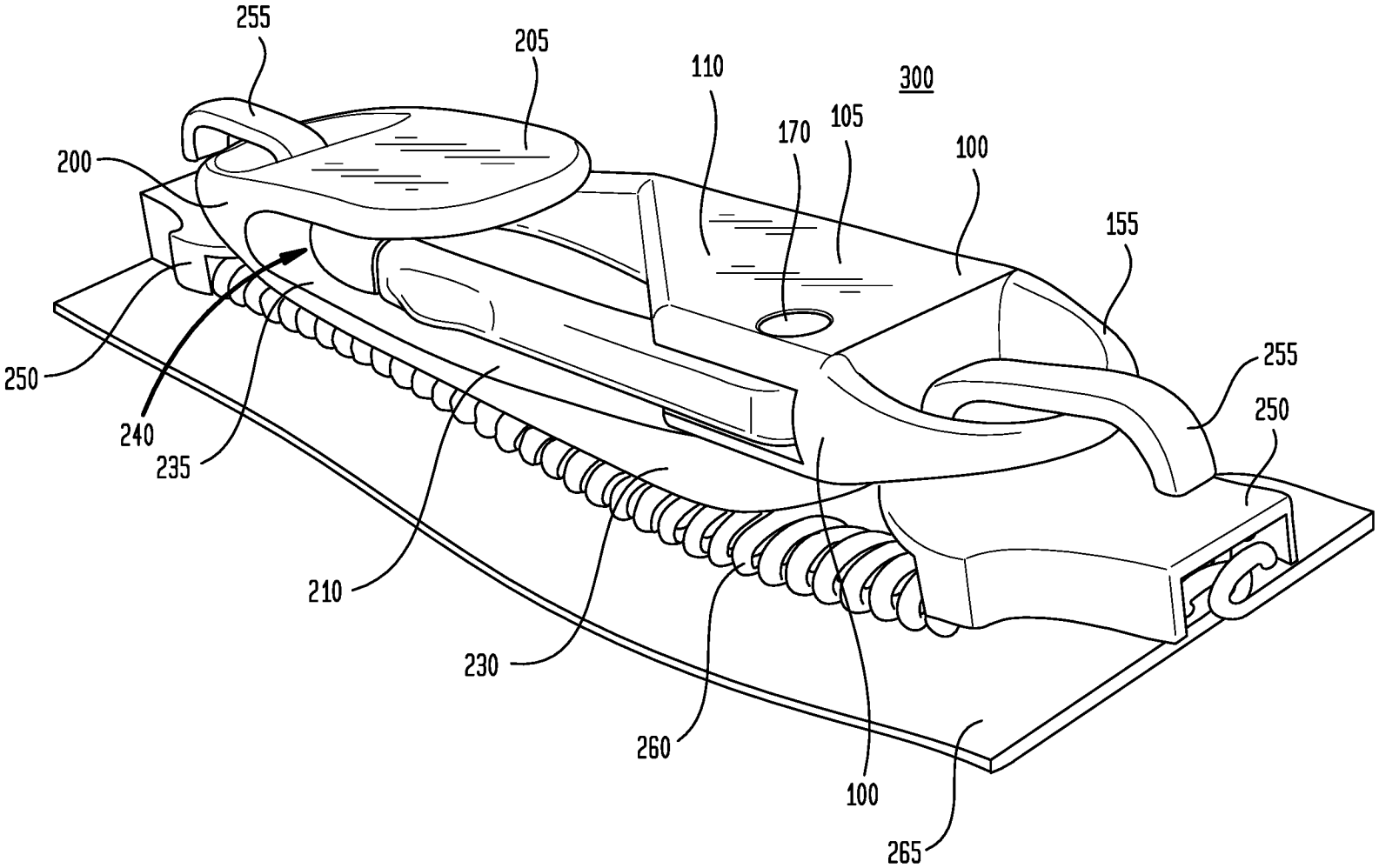
FIG. 16 is a diagram illustrating an isometric view of exemplary or representative first and second zipper pull tab embodiments coupled to respective zipper sliders and a first fastening system embodiment in an interlocked configuration.
Figure 17:
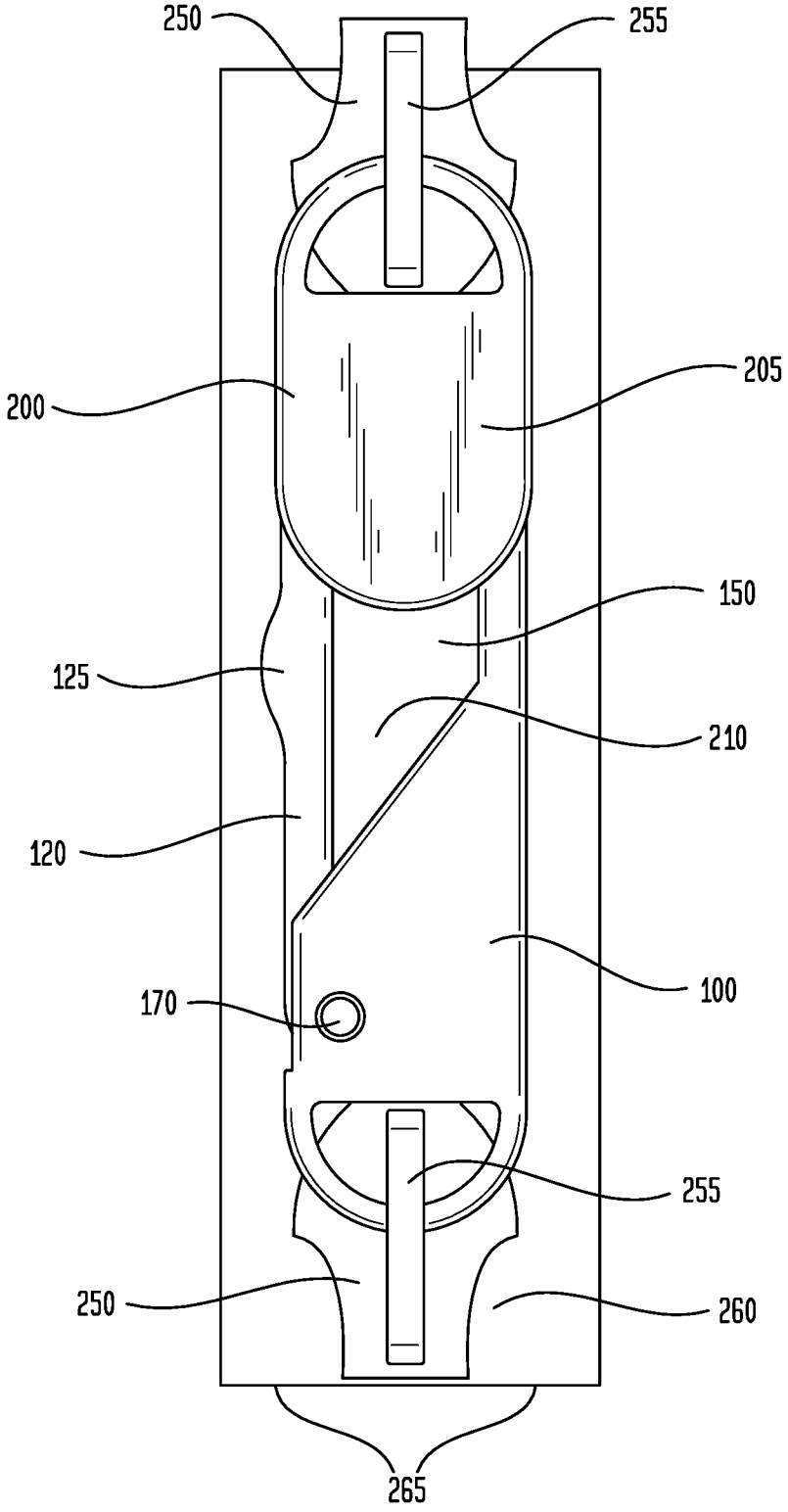
FIG. 17 is a diagram illustrating a plan, top view of exemplary or representative first and second zipper pull tab embodiments coupled to respective zipper sliders and a first fastening system embodiment in an interlocked configuration.

Referring to FIGS. 1-9, the exemplary or representative first zipper pull tab 100 comprises a body (or body portion) 110 and an elongated, generally cylindrical gate or closure member 120, referred to as a gate 120. A gate 120 may also be referred to equivalently as a closure, a rod, etc., and is described in greater detail below. The body 110 further comprises a hook (or hook portion) 115 (at a first end of the body 110) and a (first) base (or base portion) 105, with the base 105 further having a C-shaped coupling 155 (at a second end of the body 110, and arranged for coupling to a zipper slider 250 through a zipper slider coupling 255 (as illustrated in FIGS. 16-17)), and the gate 120 is disposed or arranged and pivotably movable within a generally rectangular, cuboid cavity or recess 195 of the base 105. The hook 115 is typically integrally-formed with the base 105 (at second end 147 of the hook 115), is generally elongated with a C-shaped curvature and extends from the upper part of the base 105 with a generally straight, elongated rectilinear portion 145 that is generally parallel to the gate 120, and a curved portion 140, with the hook 115 curving a first ninety degrees (curve 142) to a generally straight, rectilinear (tip of the curve) portion 146 and curving a second ninety degrees (curve 144) to terminate at a hook terminus or first end 130 as illustrated.

When the gate 120 is in a closed position or configuration as illustrated in FIGS. 1 and 2, the hook terminus or first end 130 generally abuts a first terminus or first end 135 of the gate 120, such that the hook 115 and the gate 120 create or define a first interior region 150 (opening or gap) for fastening to an object such as a second zipper pull tab 200 (as illustrated and discussed below with reference to FIGS. 15-20), or to an attachment ring of a purse, briefcase, suitcase, or other carrying bag (as illustrated and discussed below with reference to FIGS. 21 and 22). The curved portion 140 of the hook 115 has a generally constant thickness or slightly tapering thickness, while the elongated rectilinear portion 145 has a tapering thickness as an option (tapering from the second end 147 to the first end 130 and/or rectilinear portion (tip) 146 of the curve 140), also as illustrated and discussed below. Also, while illustrated as having substantially rounded edges, those having skill in the art will recognize that innumerable other designs are available and are substantially equivalent, as illustrated in the various Figures, for example and without limitation.

(To avoid confusion with the base 210 of the second zipper pull tab 200 described below, the base 105 may also be referred to as a first base, while the base 210 may also be referred to as a second base; the context of the reference to the bases, along with use of the reference numerals for a base 105 and a base 210, however, should be sufficient to differentiate and distinguish which of the first and second bases 105, 210 is being referred to and avoid any potential confusion.)

For ease of reference, directions and orientations utilized herein are with reference to the lengthwise axis of the gate 120 (which is the same as the lengthwise axis of the body 110), as the longitudinal (x-axis) dimension, with the transverse (or lateral) (y-axis) dimension extending orthogonally from the lengthwise axis of the gate 120 (or body 110) across the base 115 to the generally straight, rectilinear portion 145 of the hook 115 as the width of the first zipper pull tab 100, and with the height or thickness (z-axis or applicate) dimension extending orthogonally to both the longitudinal dimension and the transverse (lateral) dimension, e.g., across the thickness of the first zipper pull tab 100, as will be apparent to those having skill in the art from the following disclosure, for example, the transverse dimension being north or south to an east-west longitudinal dimension. Similar directions and orientations are also applicable to the second zipper pull tab 200.

The base 105 has a generally rectangular, cuboid first cavity or recess 195 extending longitudinally and transversely within the base 105 as illustrated in cut-away view in FIG. 2, to receive the generally cylindrically-shaped gate 120 and a bias (or return) spring 185 (generally a helical coil spring, but may be any type of spring, such as a leaf spring), which provides a bias or return force to maintain the gate 120 in a generally closed configuration in the first zipper pull tab 100 as illustrated in FIGS. 1, 2, and 4-6. The bias spring 185 is mounted or coupled within a second, internal recess or cavity 190 (located within the first cavity or recess 195 of the base 105), and is further coupled to a comparatively small, elongated or protruding tab 180 of the gate 120. The bias spring 185 is typically at least slightly compressed when the gate 120 is in a closed position or configuration, which tends to maintain the gate 120 in the closed position or configuration unless manipulated and opened by a user. Those having skill in the art will recognize innumerable variations on how the bias spring 185 may be arranged within the first zipper pull tab 100 (e.g., the second recess could be within the gate 120 and the protruding tab could be within the cavity or recess 195, for example and without limitation), and all such variations are considered equivalent and within the scope of the disclosure.

The base 105 and the gate 120 (at a generally wider second end 173) generally have first and second matching holes 165, 175 (shown in FIG. 9), respectively, to receive a pin coupling 170 (or equivalently a rivet, or tubular or grommet coupling), which secures the gate 120 to the base 105, and provides a pivoting axis for the gate 120, such that the gate 120 is pivotable or otherwise movable transversely (laterally) within the cavity or recess 195, for movement between an open configuration (or position) illustrated in FIG. 3 and a closed configuration (or position) illustrated in FIGS. 1, 2 and 4-6, with the direction of movement illustrated by arrow 192 (in FIGS. 1 and 2). Those having skill in the art will recognize that the gate 120 may be coupled to the body 110 and/or base 105 in many different ways, and with many different kinds of movement, all of which are considered equivalent and within the scope of the disclosure. (It should be noted that in addition to a cylindrical shape having a generally circular cross section, it is possible for the gate 120 to have any of other myriad different shapes, such as (in cross section) square, rectangular, elliptical, hexagonal, octagonal, etc., provided, however, that the gate 120 should be pivotably movable (transversely) through at least a portion of the first interior region (opening) 150 for this type of gate 120, as discussed below, for representative locking configurations or fastening systems. It should also be noted that the cavity or recess 195 may also have any of myriad shapes and sizes. All such variations are considered equivalent and within the scope of the disclosure.) Many other types of zipper pull tabs 100, with many other types of gates 120, with different types of couplings to different types of bodies 110, and with different types of gate 120 movements (such as sliding, reciprocating, pinching, rotational, lever, etc.) are illustrated and discussed below with reference to FIGS. 24-26.

In a representative embodiment as illustrated, a gate 120 comprises a generally cylindrical shaft (or rod) 122 portion and an optional grip 125, typically for feeling or grasping by a user's thumb or other finger (while holding the exemplary or representative first zipper pull tab 100 with other fingers or another hand) to thereby push the gate 120, manually depress bias spring 185 further and pivot (or otherwise manipulate) the gate 120 into an open configuration or position as illustrated in FIG. 3, in which the first terminus or end 135 of the gate 120 is positioned within the first interior region (opening) 150, such as to insert or remove an object such as a post 215 of a second zipper pull tab 200, or an attachment ring (305, 315) of a purse, briefcase, suitcase, or other carrying bag. Stated another way, the optional grip 125 can be utilized to provide a tactile landmark or feedback for a user to easily or readily position a thumb or finger to move and pivot the gate 120 to open the first zipper pull tab 100, such as for coupling or uncoupling the first zipper pull tab 100 to or from such an object. In an exemplary or representative embodiment, the optional grip 125 may have any of a plurality of shapes or sizes, symmetric or asymmetric, such as button-shaped, pear-shaped, triangular, rectangular, spherical, tab-shaped, bulb or bulbous-shaped or, as illustrated, half elliptical or ovoid, i.e., any shape for a user to grasp and/or slide with a user's thumb or fingers, for example and without limitation. In an exemplary or representative embodiment, the optional grip 125 is located at or about the upper one-third to one-half of the shaft 122 portion (from the termination or end 135), for the user to continue to be able to grasp or maintain pressure on the gate 120 when fully moved into the first interior region (or opening) 150.

The base 105 of the body 110 also has a coupling 155, illustrated as a C-shaped, integrally formed extension from the base 105, which defines or creates an opening 160, for coupling to a zipper slider 250 (through a zipper coupling 255). As illustrated in FIG. 6, the base 105 of the body 110 has a substantially flat form factor, namely, a generally uniform thickness "A", while the C-shaped coupling 155 tapers significantly in thickness, such as between 50% to 70%, from the regions 157 having a thickness "A" (e.g., 4.7 mm) to a smaller or lesser thickness (z-axis) at the first end 156 of the first zipper pull tab 100 having a thickness "B" (e.g., 1.6 mm). This structural tapering in thickness is functional, not merely aesthetic, and helps enable the first zipper pull tab 100 to lie comparatively flat against zipper teeth 260 when in use. In a representative embodiment, the thickness ratio A:B ranges from (or equal to) 2:1 to 4:1, or more particularly from (or equal to) 2.5:1 to 3.5:1, or more particularly from (or equal to) 2.8:1 to 3.1:1, or more particularly from (or equal to) 2.9:1 to 3.0:1, or more particularly about 3:1. Other methods of attaching the first zipper pull tab 100 to a zipper slider 250, such as a swivel attachment, as known in the mechanical arts, may be utilized equivalently, and those having skill in the art will recognize innumerable fixed, swiveling and/or rotatable structures and methods for securing a body 110 of first zipper pull tab 100 to a zipper slider 250, with examples illustrated in various Figures, and all such mechanisms and methods are considered equivalent and within the scope of the present disclosure.

Similarly, the hook 115 of the body 110, together with the gate 120, as mentioned above, defines or create a first interior region (or opening) 150, for coupling or fastening to an object such as a post 215 of a second zipper pull tab 200, or to an attachment ring of a purse, briefcase, suitcase, or other carrying bag. As illustrated, the base 105 tapers transversely at an angle $\alpha$ (alpha) (or equivalently, $180°—\alpha$) between 30 to 45 degrees, or more particularly between 35 to 40 degrees, or more particularly between 38 to 39 degrees, or more particularly about 38.5 degrees, from a full width "D" to a substantially smaller width "E" at the second end 147 and rectilinear portion 145 of the hook 115 (e.g., 11 mm tapering to about 2.3 mm). In a representative embodiment, the width ratio D:E ranges from (or equal to) 4:1 to 6:1, or more particularly from (or equal to) 4.5:1 to 5.5:1, or more particularly from (or equal to) 4.6:1 to 5.0:1, or more particularly from (or equal to) 4.7:1 to 4.9:1, or more particularly about 4.8:1. This structural tapering in width is also functional, not merely aesthetic, providing support for the gate 120 in the recess 195 (in the open configuration) while concurrently limiting the amount of the base 105 near the second end 173 of the gate 120, allowing greater access to the interior region 150 when the gate is in the recess 195 (in the open configuration).

Also as illustrated, the generally straight, rectilinear portion 145 of the hook 115 also tapers significantly in thickness, such as between 45% to 65% of the thickness "A", from the second end (or region) 147 of the hook 115 (e.g., 4.7 mm) (also having a thickness "A") (typically integrally formed with the base 105) to a smaller or lesser (second or third) thickness "C" (z-axis) at the rectilinear (tip of the curve) portion 146 (e.g., 2.6 mm). This structural tapering in thickness is also functional, not merely aesthetic, and helps enable the first zipper pull tab 100 to readily lock to second zipper pull tab 200 when in use without creating excessive thickness, so both tabs 100, 200 collectively lie comparatively flat against zipper teeth 260 when interlocked in use. In a representative embodiment, the thickness ratio A:C ranges from (or equal to) 3:1 to 1.5:1, or more particularly from (or equal to) 2.5:1 to 1.5:1, or more particularly from (or equal to) 2.0:1 to 1.7:1, or more particularly from (or equal to) 1.9:1 to 1.7:1, or more particularly about 1.8:1.

Given that the base 105 of the body 110 has a substantially flat form factor, and that the hook 115 and C-shaped coupling 155 both taper in thickness, the first zipper pull tab 100 overall maintains a substantially flat form factor. Stated another way, there are no components which protrude further in the z-axis direction away from the top side 107 or the bottom side 103 of the base 105 (or protrude further in the z-axis direction away from the x-y planes formed by the top side 107 or the bottom side 103 of the base 105), allowing the first zipper pull tab 100 to be substantially flat and lie flat against and in parallel with a zipper 265. This provides additional security, as the first zipper pull tab 100 does not protrude from a carrying bag 310, serving to diminish the probability of an inadvertent catching or snagging of the first zipper pull tab 100 and any unwanted opening of a zipped pocket or compartment in the carrying bag 310.

Referring to FIGS. 7 and 8, additional details of the first end 135 of the gate 120 and the end 130 of the hook 115 are illustrated. As illustrated, the first end 135 of the gate 120 and the end 130 of the hook 115 have mating arrangements or configurations to diminish or minimize movement of the gate 120 relative to the body 110 when the gate 120 is in a closed configuration. The end 130 of the hook 115 has surfaces or faces 132, extending both in the longitudinal and transverse dimensions, and the first end 135 of the gate 120 also has mating surfaces or faces 137, also extending both in the longitudinal and transverse dimensions. As a result, the gate 120 may be moved and pivoted transversely only within the first interior region (opening) 150, with other transverse movement away from the body 110 stopped or prevented by the end 130 of the hook 115. Secondly, the end 130 of the hook 115 has a (second) tab (or tab structure), protrusion or extension 136 (with faces 129 symmetrically on each side), and the first end 135 of the gate 120 has a mating recess or cavity 139 (which extension and cavity also may be reversed with respect to the other), which are engaged with each other when the gate 120 is in a closed configuration and which generally stop or prevent any significant movement of the gate 120 in the z-axis. Those having skill in the art will recognize that the arrangements of the mating recess or cavity 139 at the first end 135 of the gate 120 and the tab 136 at the end 130 of the hook 115 may be reversed: equivalently, the tab, protrusion or extension 136 may be arranged or positioned at the first end 135 of the gate 120 and the mating recess or cavity 139 may be arranged or positioned at the end 130 of the hook 115 (not separately illustrated).

In the illustrated representative embodiment of the first zipper pull tab 100, when the gate 120 is in a closed position or configuration, the gate 120 is substantially parallel to the straight, elongated rectilinear portion 145 of the hook 115 (and more generally, the side 121 of the body 110). This creates an overall, aesthetic appearance of the first zipper pull tab 100 as a generally flat, rectangular cuboid having curvilinear corners.

It should also be noted, however, that the first zipper pull tab 100 may have any of a plurality of shapes and sizes, all of which are considered equivalent and within the scope of the disclosure, including those illustrated in FIGS. 24-26. It should be noted further that in addition to the spring biased gate 120 opening inwardly into the first interior region (opening) 150, the first zipper pull tab 100 may have any of a plurality of opening (unlocking) and closing (locking) mechanisms, all of which are considered equivalent and within the scope of the disclosure, including those illustrated in FIGS. 24-26.

In addition, those having skill in the art will recognize that the size, shape and material selection for first zipper pull tab 100 (e.g., gate 120 and body 110) should be sufficiently strong for its or their intended use and application, and are typically determined based on their application and anticipated stress or weight load, along with aesthetic considerations, such as for a light purse compared to a heavy suitcase (e.g., comprising a material such as a metal or metal alloy, a polymer, a plastic, carbon fiber, wood, etc., as described below), also for example and without limitation.

In use, the first and second zipper pull tabs 100, 200 are each generally grasped by a user, such as with a thumb on a top side 107 and a forefinger on a bottom side 103 of the first zipper pull tab 100 (or vice-versa), or on a top side 211 (illustrated as top side 211A for the (second) base 210 and top side 211B for the cover 205, collectively referred to as top side 211 for the second zipper pull tab 200) and a forefinger on a bottom side 212 of the second zipper pull tab 200 (or vice-versa), and used to pull a zipper slider 250 to open or close a zipper 265 having zipper teeth 260 (illustrated in FIGS. 16 and 17). Any type of zipper 265 and corresponding zipper slider 250 may be utilized with the first and second zipper pull tabs 100, 200, including zippers 265 having single and double rows of zipper teeth 260, with a single row of zipper teeth 260 illustrated in FIGS. 16 and 17. As such, the first zipper pull tab 100 and second zipper pull tab 200 typically have comparatively small but readily graspable form factors. For example, an exemplary or representative embodiment of a first zipper pull tab 100 typically has a length of about 20-50 mm, (e.g., 37-38 mm), and a width of about 5-15 mm, (e.g., 11 mm), while having a thickness (which may be variable, as discussed below) of about 1-10 mm, (e.g., 1.6 to 4.7 mm). Also for example, an exemplary or representative embodiment of a second zipper pull tab 200 typically has a length of about 20-50 mm, (e.g., 38 mm), and a width of about 5-15 mm, (e.g., 11 mm), while having a thickness (which may be variable, as mentioned above) of about 1-8 mm, (e.g., 1.5 to 6.3 mm).

Those having skill in the art will recognize that there are many available variations of the first zipper pull tab 100, varying the gate 120 closure mechanisms and/or varying the body 110 and hook 115 shapes, structures and configurations. Many such variations are illustrated and described below with reference to FIGS. 24-26, as additional gate 120A-120T closure mechanisms with additional body and hook shapes, structures and configurations for a first zipper pull tab 100A-100T, which are all able to function and work with the second zipper pull tab 200 to have interlocked first and second zipper pull tabs 100, 200 as described below, and all such variations are considered equivalent and within the scope of the claims herein. For example, while there are aesthetic and mechanical variations among them, all of the additional variations of the first zipper pull tab 100A-100T have a substantially flat overall form factor to be grasped readily by a user for use as a zipper pull tab and which will lie flat against a zipper 265 or second zipper pull tab 200 in use, all have a locking gate 120A-120T, all may function and work with the second zipper pull tab 200, 200A-200D to have interlocked first and second zipper pull tabs 100, 200 as described in greater detail below, and all may be utilized further in the first, second, third and fourth fastening system embodiments, including for locking to another object, such as the various coupling rings 305, 315. Accordingly, any and all references herein to a first zipper pull tab 100 will be understood to mean and include any and all of the illustrated first zipper pull tabs 100A-100T and any and all other equivalent variations.

Figure 10:
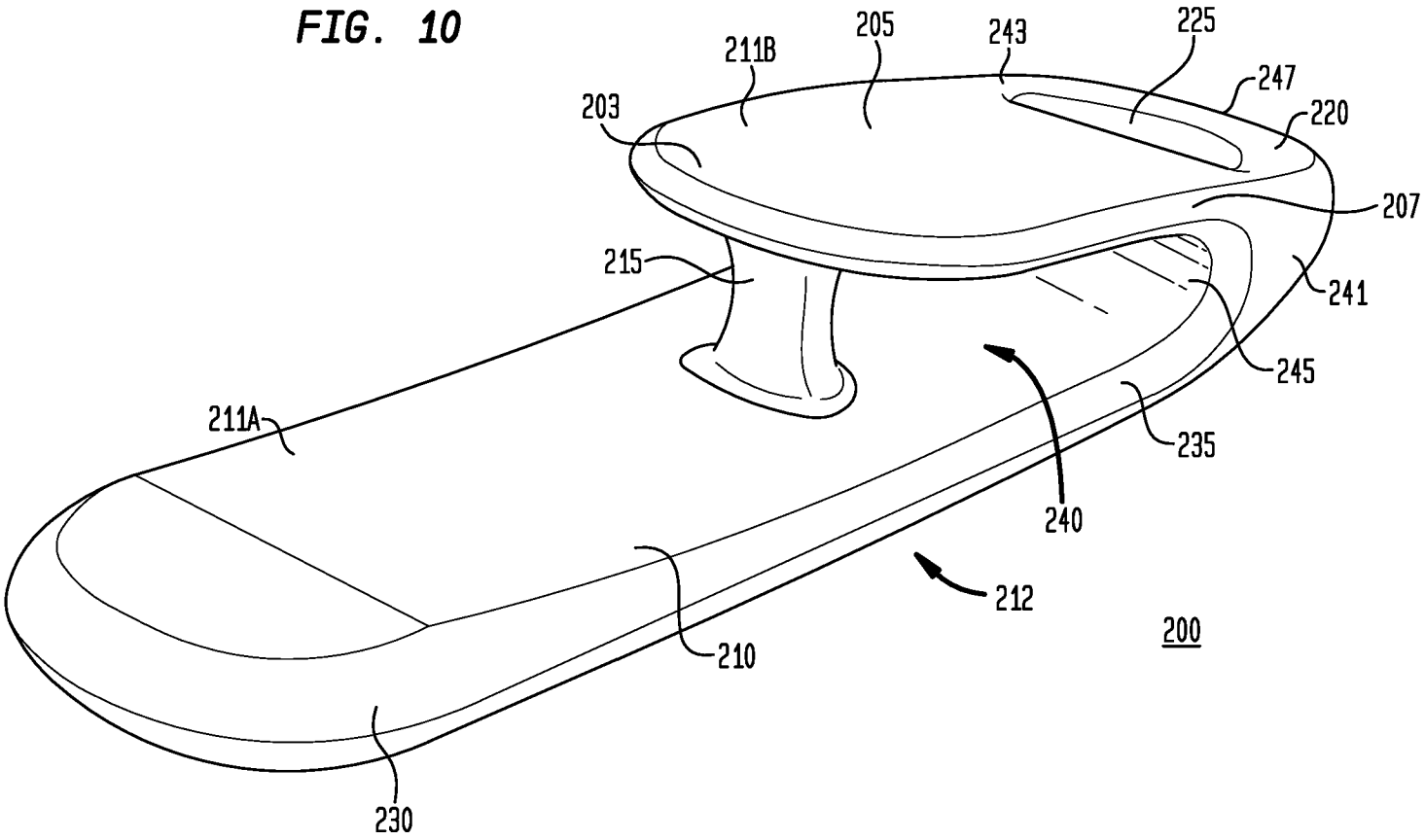
FIG. 10 is a diagram illustrating an isometric view of an exemplary or representative second zipper pull tab embodiment.
Figure 11:
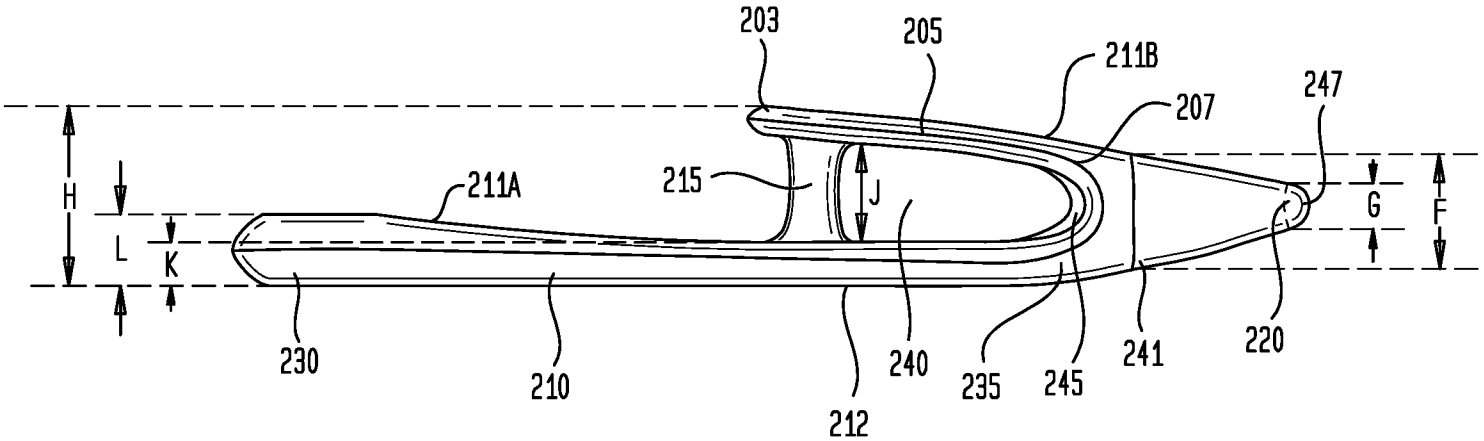
FIG. 11 is a diagram illustrating a plan view of a first side of an exemplary or representative second zipper pull tab embodiment.
Figure 12:
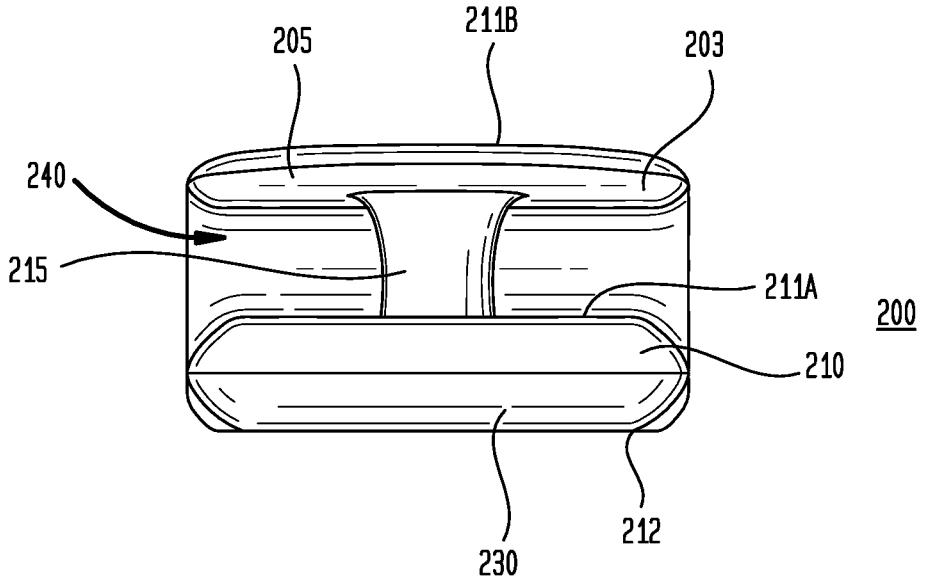
FIG. 12 is a diagram illustrating a plan view of a second side of an exemplary or representative second zipper pull tab embodiment.
Figure 13:
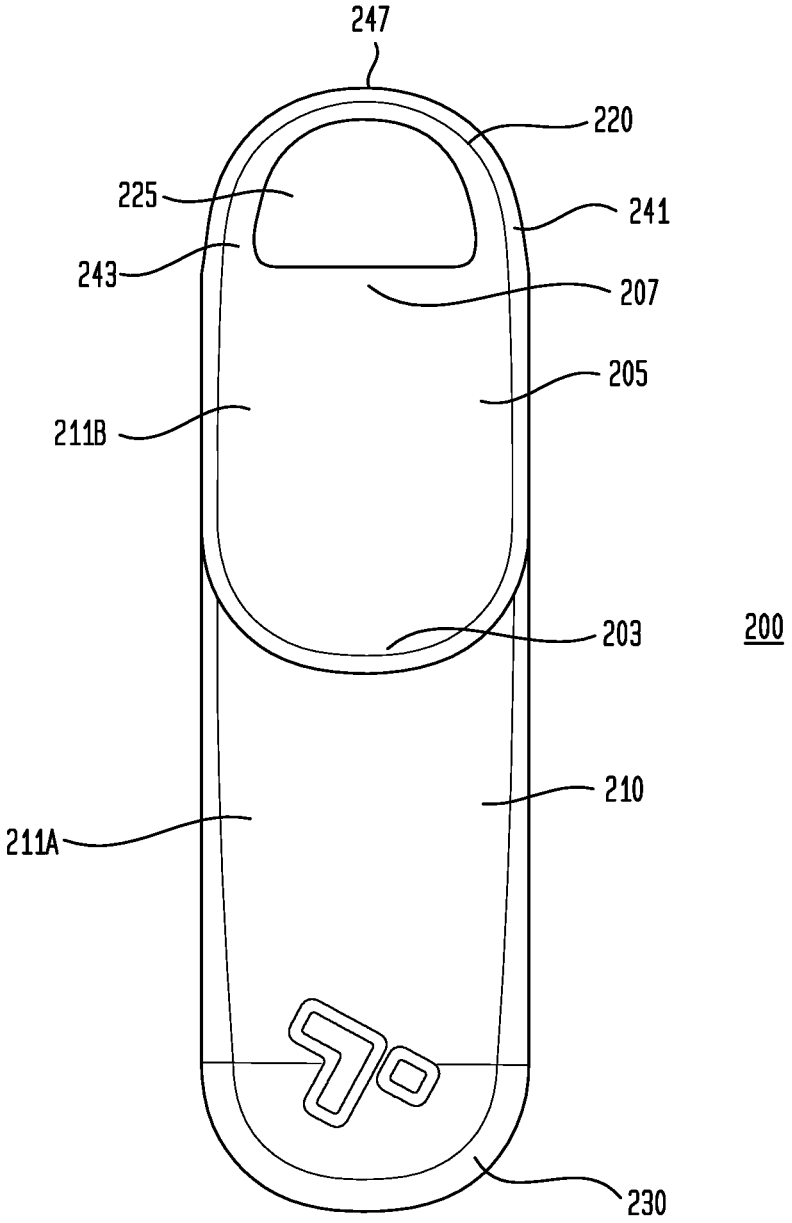
FIG. 13 is a diagram illustrating a plan view of a first, top side of an exemplary or representative second zipper pull tab embodiment in a closed configuration.
Figure 14:
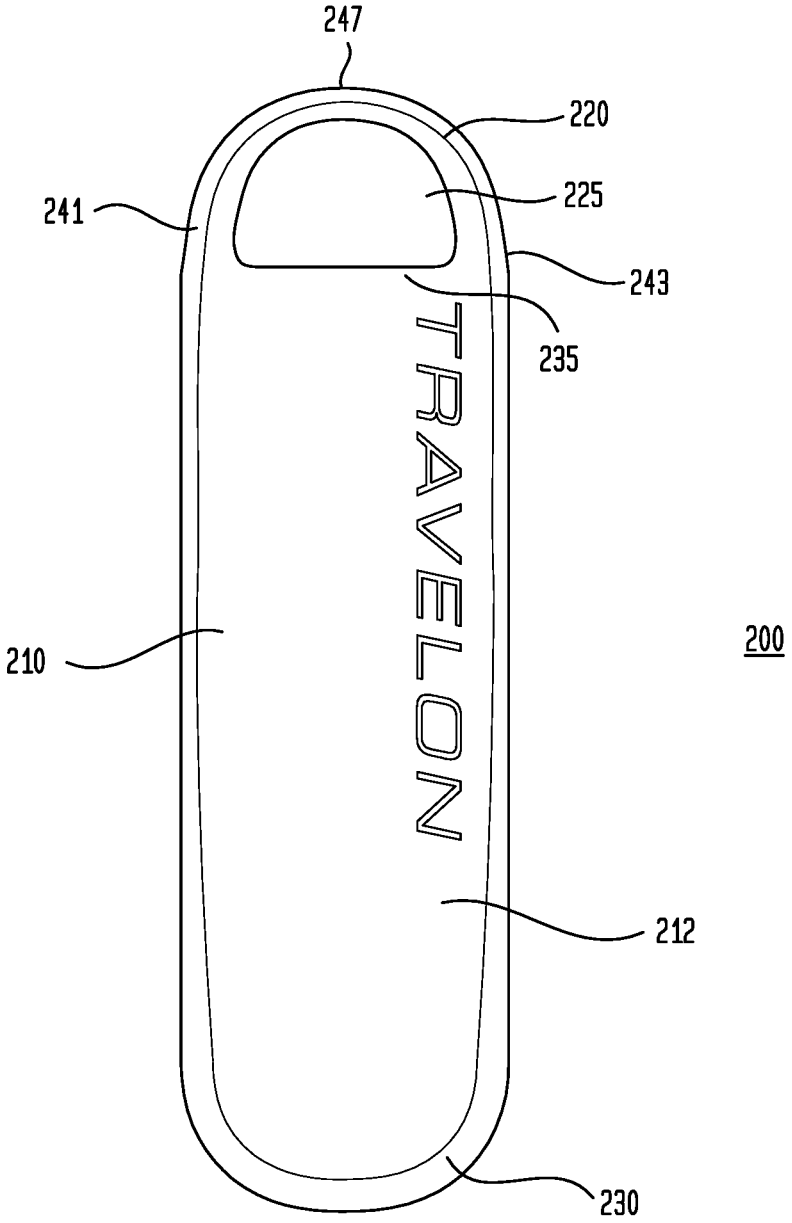
FIG. 14 is a diagram illustrating a plan view of a second, bottom side of an exemplary or representative second zipper pull tab embodiment in a closed configuration.

FIG. 10 is a diagram illustrating an isometric view of an exemplary or representative second zipper pull tab 200 embodiment. FIG. 11 is a diagram illustrating a plan view of a first side of an exemplary or representative second zipper pull tab 200 embodiment. FIG. 12 is a diagram illustrating a plan view of a second side of an exemplary or representative second zipper pull tab 200 embodiment. FIG. 13 is a diagram illustrating a top view of a first, top side 211A, 211B of an exemplary or representative second zipper pull tab 200 embodiment in a closed configuration. FIG. 14 is a diagram illustrating a top view of a second, bottom side 212 of an exemplary or representative second zipper pull tab 200 embodiment in a closed configuration.

Referring to FIGS. 10-14, the exemplary or representative second zipper pull tab 200 comprises a base 210, a cover 205, and a post (pillar or rod) 215 extending between the base 210 and cover 205. The second zipper pull tab 200 also has a coupling 220, illustrated as a C-shaped extension from the respective proximal ends 235, 207 of the base 210 and the cover 205, which defines or creates an opening 225, for coupling to a zipper slider 250 (through a zipper coupling 255). The cover 205 has a proximal end 207 and a distal end 203, and the base 210 also has a proximal end 235 and a distal end 230. The cover 205 and the base 210 are coupled to each other at their respective proximal ends, forming a curved wall or face 245, as illustrated. Also as illustrated, the post 215 extends between the base 210 and cover 205, from (or between) approximately the middle third (or the distal portion of the proximal half) of the base 210 to at or near the distal end 203 of the cover 205, with the base 210, cover 205 and post 215 creating or defining a second interior region (or opening) 240.

As discussed in greater detail below, gate 120 is opened, the hook 115 of the first zipper pull tab 100 is inserted into the second interior region (or opening) 240, the gate 120 is closed, and the first zipper pull tab 100 is then locked around the post 215, interlocking the first and second zipper pull tabs 100, 200. The post 215 is illustrated as generally elliptical (oval) in cross section (x-y axis), and comparatively larger dimensions along the major and minor axes where the post 215 joins (and is usually integrally formed with) the cover 205 and base 210. It will be appreciated by those having skill in the art that the post 215, the cover 205, and the base 210 may have innumerable shapes and sizes, all of which are considered equivalent and within the scope of the disclosure. For example and without limitation, the post 215 in cross section may be circular, square, rectangular, hexagonal, octagonal, triangular, etc. In addition, the post 215 is not required to be solid and continuous; however, any gap in the post 215 should be smaller than the thickness of the hook 115 of the first zipper pull tab 100 to avoid the hook 115 from inadvertently falling or sliding out of the second interior region (or opening) 240 when the first and second zipper pull tabs 100, 200 are supposed to be interlocked. While illustrated as having one post 215, those having skill in the art will recognize that additional posts 215 may be utilized in a second zipper pull tab 200, and may be spaced together or spaced apart, to the extent interlocking configurations can continue to be implemented. In addition, those having skill in the art will recognize that the size, shape and material selection for the post 215, cover 205, base 210, and coupling 220 should be sufficiently strong for its or their intended use and application, and are typically determined based on their application and anticipated stress or weight load, along with aesthetic considerations, such as for a light purse compared to a heavy suitcase, also for example and without limitation, as mentioned above for the first zipper pull tab 100, and also as described in greater detail below.

In a representative embodiment, the size(s) of the diameter (or width and length) of the post 215, in the x-y plane of the second zipper pull tab 200, and the position of the post 215 with respect to the wall or face 245, are determined comparatively or relatively to the dimension of the first zipper pull tab 100. More specifically, the diameter (or width and length) of the post 215 is comparatively sized to be generally greater than the allowable amount of opening of the gate 120, when the gate 120 is in a closed configuration and the first and second zipper pull tabs 100, 200 are interlocked in the second interlocked state (or configuration) as discussed in greater detail below. Also, the position of the post 215, with respect to the wall or face 245, is comparatively located or arranged to block or diminish any significant opening of the gate 120 when the first and second zipper pull tabs 100, 200 are interlocked in the second interlocked state (or configuration), also as discussed in greater detail below.

The second zipper pull tab 200 also has a coupling 220, illustrated as a C-shaped extension integrally from both the cover 205 and the base 210, which defines or creates an opening 225, for coupling to a zipper slider 250 (through a zipper coupling 255). As illustrated, the C-shaped coupling 220 also tapers significantly in thickness, such as between 50% to 70%, from the regions 241, 243 having a thickness "F" (e.g., 4.7 mm) to a smaller or lesser thickness (z-axis) at the end 247 having a thickness "G" (e.g., 1.6 mm). This structural tapering in thickness is also functional, not merely aesthetic, and also helps enable the second zipper pull tab 200 to lie comparatively flat against zipper teeth 260 when in use. In a representative embodiment, the thickness ratio F:G ranges from (or equal to) 2:1 to 4:1, or more particularly from (or equal to) 2.5:1 to 3.5:1, or more particularly from (or equal to) 2.8:1 to 3.1:1, or more particularly from (or equal to) 2.9:1 to 3.0:1, or more particularly about 3:1. It should also be noted that the second zipper pull tab 200 has an overall thickness "H" (e.g., 6.29 mm), with H>A. The second interior region (or opening) 240 also has a maximum height of "J", with the height "J" also tapering toward the wall or face 245, and with the height "J" greater than and generally tracking or corresponding to the tapering of the thickness of the hook 115 discussed above and as illustrated.

Other methods of attaching the second zipper pull tab 200 to a zipper slider 250, such as a swivel attachment, as known in the mechanical arts, may be utilized equivalently, and those having skill in the art will recognize innumerable fixed, swiveling and/or rotatable structures and methods for securing a base 210 or base 210 and cover 205 of a second zipper pull tab 200 to a zipper slider 250, and all such mechanisms and methods are considered equivalent and within the scope of the present disclosure. It should also be noted that the second zipper pull tab 200 may have any of a plurality of shapes and sizes, all of which are considered equivalent and within the scope of the disclosure An additional feature of the second zipper pull tab 200 is that the distal end 230 of the base 210 having a first thickness "L" is comparatively thicker than the proximal end 235 having a second thickness "K", such as about 30%-80% thicker (e.g., a distal end 230 thickness "L" of 2.50 mm compared to thickness "K" of about 1.5 mm at the proximal end 235). This structural tapering in thickness is also functional, not merely aesthetic, and also enables the second zipper pull tab 200 to exert pressure against the first zipper pull tab 100 in the interlocked configurations, serving to prevent inadvertent sliding of the first and second zipper pull tabs 100, 200 apart from each other and stabilizes the interlocked configurations. In a representative embodiment, the thickness ratio L:K ranges from (or equal to) 4:1 to 1.25:1, or more particularly from (or equal to) 2:1 to 1.25:1, or more particularly from (or equal to) 1.75:1 to 1.25:1, or more particularly from (or equal to) 1.75:1 to 1.5:1, or more particularly about 1.67:1.

Those having skill in the art will recognize that there are many available variations of the second zipper pull tab 200, varying the post 215 structure and configuration, and cover 205 and base 210 shapes, structures and configurations. Many such variations are illustrated and described below with reference to FIG. 27, as additional post 215A-215D structures and configurations with additional cover 205A-205D and base 210A-210D shapes, structures and configurations for a second zipper pull tab 200A-200D, which are all able to function and work with the first zipper pull tab 100 to have interlocked first and second zipper pull tabs 100, 200 as described below, and all such variations are considered equivalent and within the scope of the claims herein. For example, while there are aesthetic and structural variations among them, all of the additional variations of the second zipper pull tab 200A-200D have a substantially flat overall form factor to be grasped readily by a user for use as a zipper pull tab and which will lie flat against a zipper 265 or first zipper pull tab 100 in use, all have a post 215A-215D structures which will work with a locking gate 120, 120A-120T, and all may function and work with the first zipper pull tab 100 to have interlocked first and second zipper pull tabs 100, 200 as described in greater detail below. Accordingly, any and all references herein to a second zipper pull tab 200 will be understood to mean and include any and all of the illustrated second zipper pull tabs 200A-200D and any and all other equivalent variations.

Figure 15:
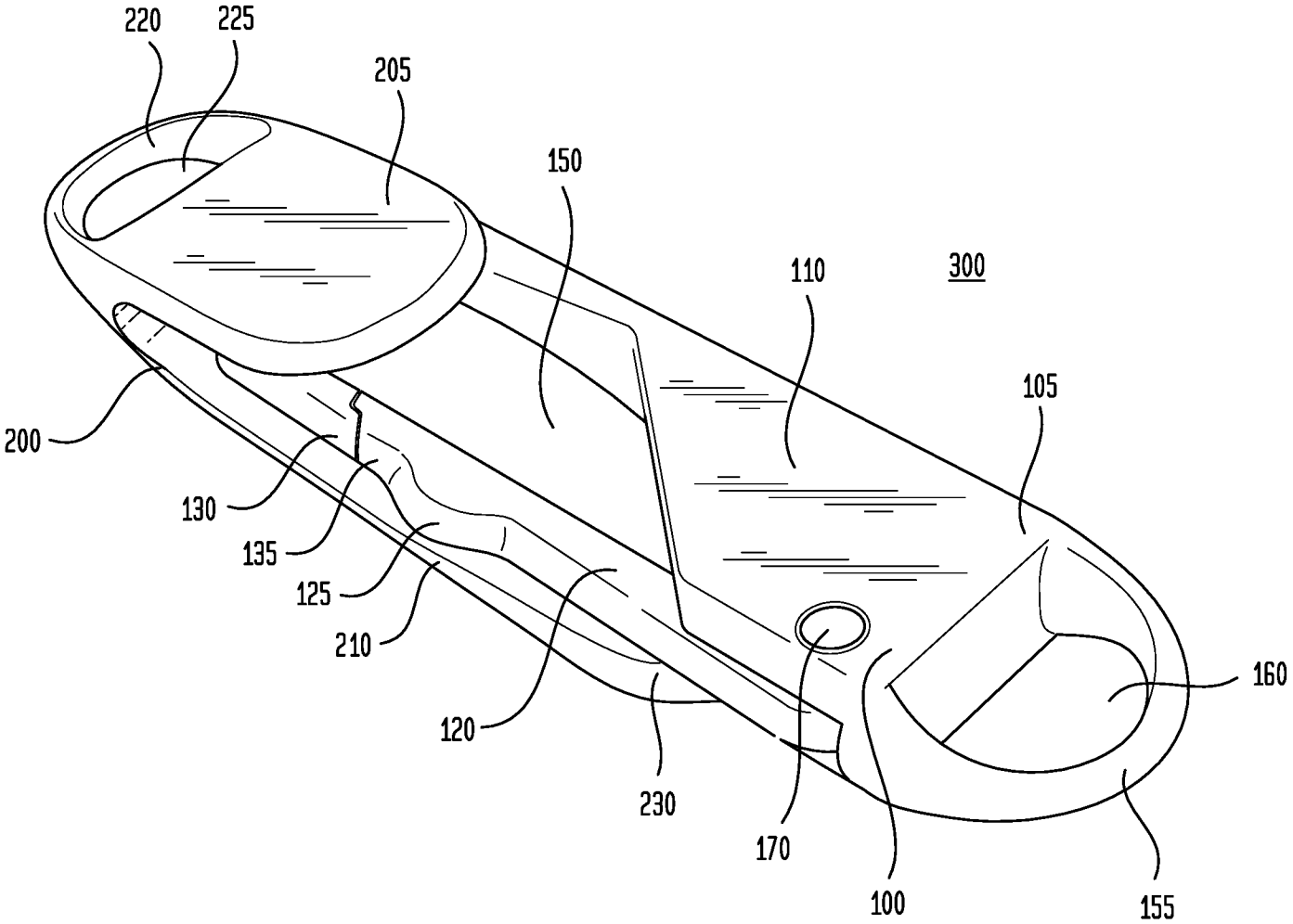
FIG. 15 is a diagram illustrating an isometric view of exemplary or representative first and second zipper pull tab embodiments and a first fastening system embodiment in an interlocked configuration.
Figure 18:
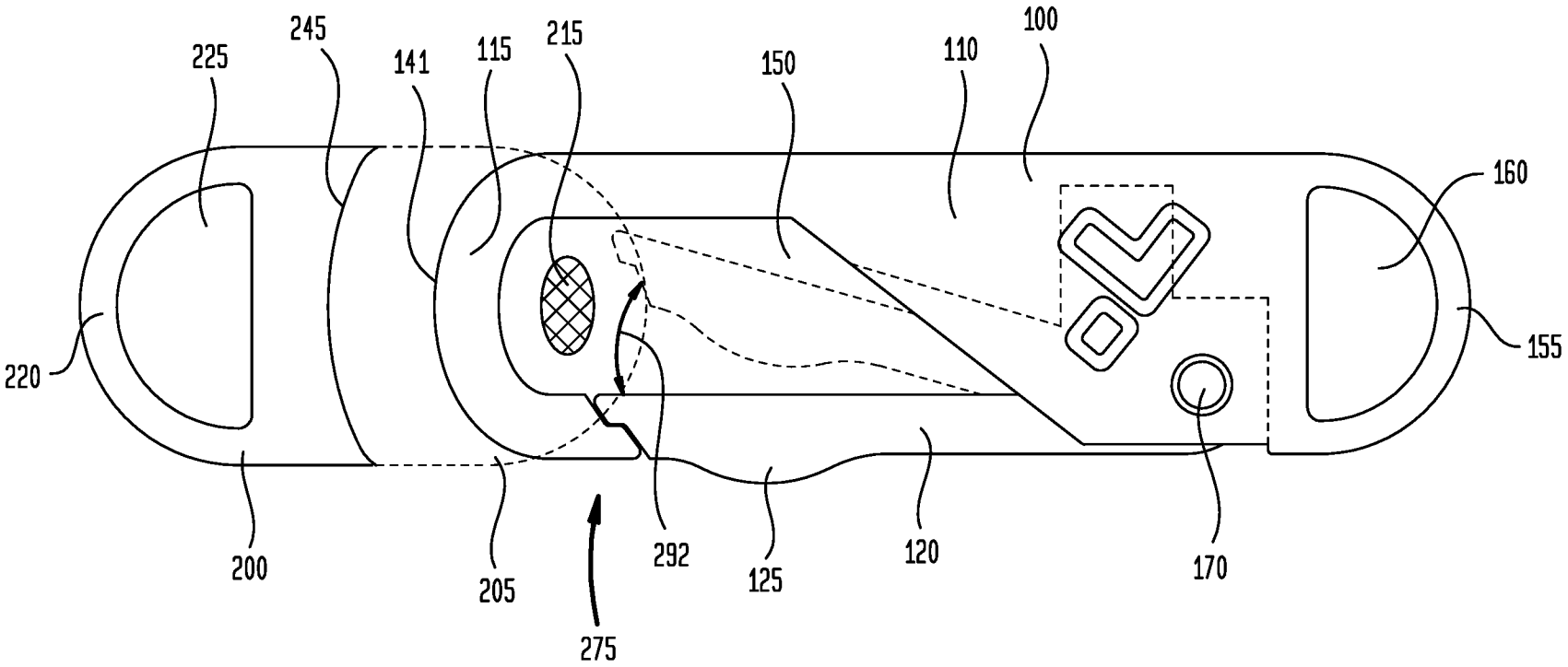
FIG. 18 is a diagram illustrating a plan, top cut-away view of exemplary or representative first and second zipper pull tab embodiments in a first interlocked state or configuration.
Figure 19:
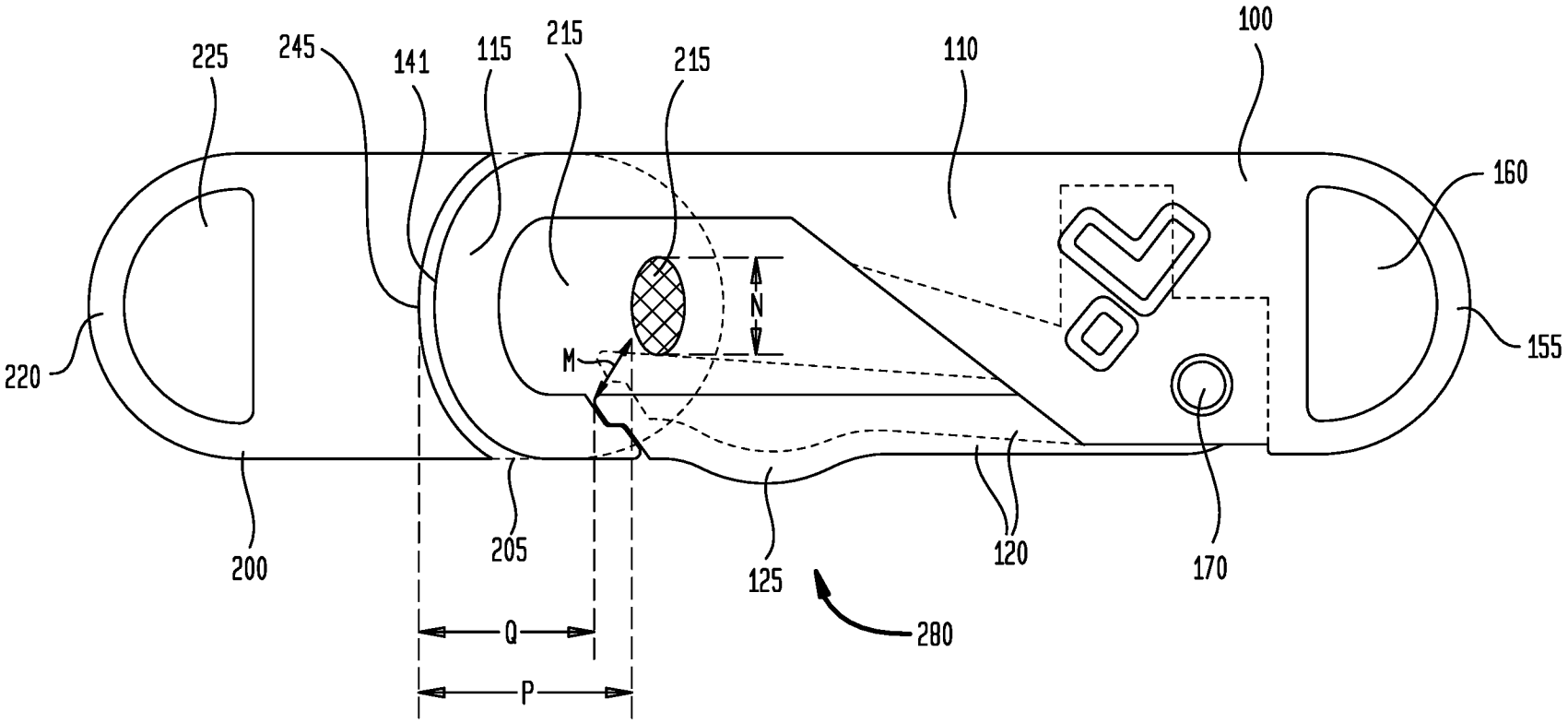
FIG. 19 is a diagram illustrating a plan, top cut-away view of exemplary or representative first and second zipper pull tab embodiments in a second interlocked state or configuration.

FIG. 15 is a diagram illustrating an isometric view of exemplary or representative first and second zipper pull tab 100, 200 embodiments and a first fastening system 300 embodiment in an interlocked configuration. FIG. 16 is a diagram illustrating an isometric view of exemplary or representative first and second zipper pull tab 100, 200 embodiments coupled to respective zipper sliders 250 and illustrating a first fastening system 300 embodiment in an interlocked configuration. FIG. 17 is a diagram illustrating a plan, top view of exemplary or representative first and second zipper pull tab 100, 200 embodiments coupled to respective zipper sliders 250 and illustrating a first fastening system 300 embodiment in an interlocked configuration. FIG. 18 is a diagram illustrating a plan, top cut-away view of exemplary or representative first and second zipper pull tab 100, 200 embodiments in a first interlocked state or configuration 275, in which the cover 205 is shown in a cut-away view (dotted lines) to illustrate the second interior region (or opening) 240 in the first interlocked state or configuration 275. FIG. 19 is a diagram illustrating a plan, top cut-away view of exemplary or representative first and second zipper pull tab 100, 200 embodiments in a second interlocked state or configuration 280, in which the cover 205 is shown in a cut-away view (dotted lines) to illustrate the second interior region (or opening) 240 in the second interlocked state or configuration 280.

Referring to the Figures, the locking (interlocking) and unlocking of the first and second zipper pull tabs 100, 200 requires a series or succession of a plurality of movements of the gate 120 relative to the post 215 and respective movements of the first and second zipper pull tabs 100, 200, typically as coupled to respective zipper sliders 250 as illustrated in FIGS. 16 and 17. This plurality of different and separate movements is effectively implemented and controlled by the configurations and arrangements of the components of the first and second zipper pull tabs 100, 200. In the exemplary or representative embodiments, three (or more) different movements of the gate 120 relative to the post 215 and respective movements first and second zipper pull tabs 100, 200 are utilized. Those having skill in the mechanical arts will recognize, however, that only a plurality (two) of different movements are necessary to achieve at least some locking and security functionality of the present disclosure.

FIGS. 20A, 20B, 20C and 20D serve to illustrate an exemplary or representative sequence of operations to lock together (interlock), as a first fastening system embodiment 300, and unlock and separate, the exemplary or representative first and second zipper pull tabs 100, 200.

In operation, for a first fastening system embodiment 300, the first zipper pull tab 100 interlocks with the second zipper pull tab 200, as illustrated in FIGS. 15-20. The first and second zipper pull tabs 100, 200 are illustrated as unlocked and uncoupled in FIG. 20A. Typically, the first and second zipper pull tabs 100, 200 are brought closely together, and as a first movement, the gate 120 of the first zipper pull tab 100 is depressed (into first interior region (opening) 150) to have an open position, creating an opening between the hook end 130 and first end 135 of the gate 120, referred to as an open position or open configuration (illustrated in FIGS. 3 and 20B). As a second and distinct movement, while the gate 120 is in an open position, the first zipper pull tab 100 is rotated with respect to the second zipper pull tab 200 (or both rotated with respect to each other), and as a third movement, the hook 115 is then inserted into the second interior region (or opening) 240 and around the post 215 of the second zipper pull tab 200 (illustrated in FIG. 20B), and the gate 120 is released, with the force exerted by bias spring 185 returning the gate 120 into a closed position, i.e., closing the opening between the hook end 130 and first end 135 of the gate 120, referred to as an closed position or closed configuration with the hook end 130 abutting the first end 135 of the gate 120. As a result, the first and second zipper pull tabs 100, 200 are then in an interlocked configuration, illustrated in FIG. 20C (the first interlocked state or configuration 275). These steps are generally reversed to uncouple the first zipper pull tab 100 and second zipper pull tab 200, as described in greater detail below.

Figure 20A:
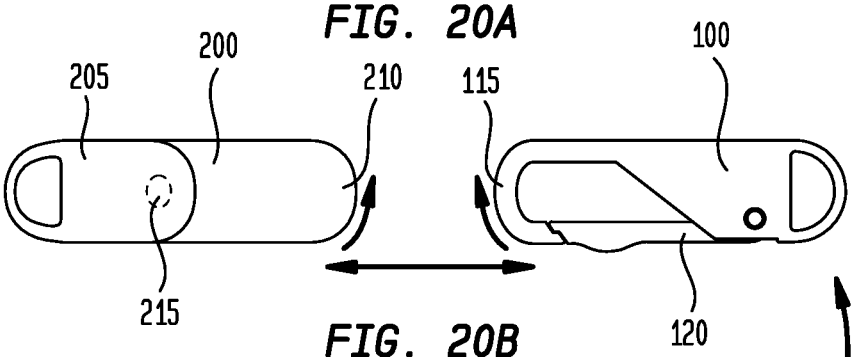
FIGS. 20A, 20B, 20C, and 20D (collectively referred to herein as "FIG. 20") are diagrams illustrating a sequence of interlocking and unlocking steps, in plan, top cut-away views, of exemplary or representative first and second zipper pull tab embodiments respectively in an unlocked state or configuration, a locking process, a first interlocked state or configuration, and a second interlocked state or configuration.
Figure 20B:
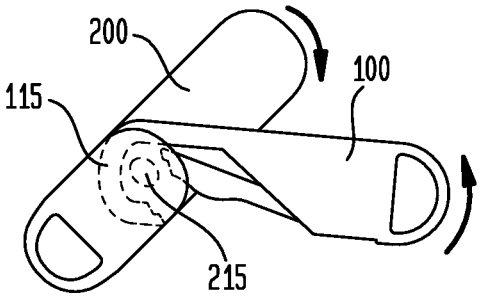
Figure 20C:
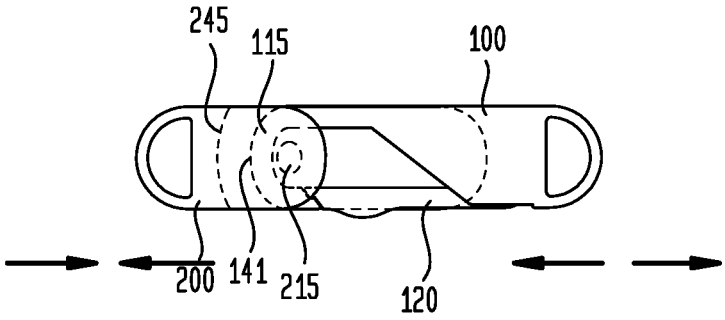

Referring to FIGS. 18, 19, 20C and 20D, there are at least two states or positions of the interlocked configuration of the first and second zipper pull tabs 100, 200, formed by the relative positions or arrangements of the first zipper pull tab 100 and the second zipper pull tab 200. The first interlocked state or configuration 275 is illustrated in FIGS. 18 and 20C, and is typically created and in place when the first and second zipper pull tabs 100, 200 are initially interlocked or about to be unlocked, as the gate 120 is fully pivotable across the first interior region (opening) 150, and the second end 141 of the first zipper pull tab 100 (at the hook 115) is spaced apart from the wall or face 245 of the second zipper pull tab 200 (at the proximal ends of the base 210 and cover 205). The first and second zipper pull tabs 100, 200 may be uncoupled from this first interlocked state 275, by depressing the gate 120 into the first interior region (opening) 150, rotating and removing the hook 115 from the second interior region (or opening) 240 and the post 215.

Figure 20D:
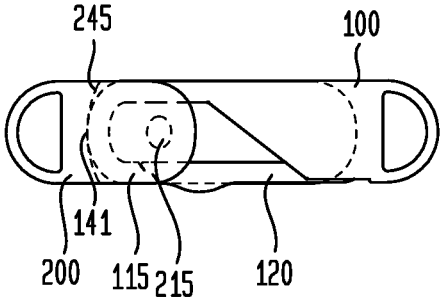

The second interlocked state or configuration 280 is illustrated in FIGS. 19 and 20D, and is typically created as a next step after the first and second zipper pull tabs 100, 200 are initially interlocked, as a fourth separate and distinct movement, by the user pushing or pressing the first and second zipper pull tabs 100, 200 closer together, such that the second end 141 of the first zipper pull tab 100 (at the hook 115) is closer to or abutting the wall or face 245 of the second zipper pull tab 200 (at the proximal ends of the base 210 and cover 205). This operation also moves or cinches the two zipper sliders 250 closer together, which further helps to maintain the gate 120 and post 215 positioned relative to one another in the second interlocked state or configuration 280. For this second interlocked state or configuration 280, the post 215 has been positioned, relative to the gate 120, to effectively or significantly block the pivoting of the gate 120 into the first interior region (opening) 150, as illustrated using a dashed line in FIG. 19.

This blocking is optional and certainly not required to be 100% or otherwise complete. In a first representative embodiment, the gate 125 may be blocked just to the extent of requiring some (at least minimal) amount of movement of the first and second zipper pull tabs 100, 200 apart from each other, as a separate action or movement performed by a user. In another representative embodiment, the pivoting of the gate 120 is blocked to the extent which would otherwise be needed to remove the post 215 from the first interior region (opening) 150, i.e., any allowable or remaining gap between the end 130 of the hook 115 and the first end 135 of the gate 120 should merely be smaller than the diameter (or smallest lateral dimension) of the post 215.

For this latter embodiment, the smallest transverse diameter (or width and length) "N" of the post 215 is comparatively sized to be generally greater than the allowable amount of opening of the gate 120 "M", when the gate 120 is in a closed configuration and the first and second zipper pull tabs 100, 200 are interlocked in the second interlocked state (or configuration) 280. For both of these embodiments for the second interlocked state 280, the position of the post 215, with respect to the wall or face 245 (distance "P"), is comparatively located or arranged to significantly block opening of the gate 120 when the first and second zipper pull tabs 100, 200 are interlocked in the second interlocked state (or configuration) 280, i.e., P>Q, as illustrated in FIGS. 19 and 20D. Stated another way, in the second interlocked state or configuration 280, movement of the gate 120 into the first interior region 150 is at least partially blocked by the post 215. In a representative embodiment, in the second interlocked state or configuration 280, movement of the gate 120 into the first interior region 150 is sufficiently blocked by the post 215 that the first and second zipper pull tabs 100, 200 cannot be completely unlocked from each other (without breaking them) until moved further apart from each other, with corresponding unzipping, to return to the first interlocked state or configuration 275.

To return the first and second zipper pull tabs 100, 200 to the first interlocked state 275 from the second interlocked state 280, and further to unlock and separate the first and second zipper pull tabs 100, 200 from each other, several separate and distinct movements by the user are also required, creating significant security from inadvertent or unauthorized opening of a zipper 265. From the second interlocked state 280, it is insufficient to merely depress the gate 120 and try to manipulate the first zipper pull tab 100 away from the second zipper pull tab 200, as the gate 120 is blocked by the post 215. Rather, as a first separate and distinct movement, each of the first and second zipper pull tabs 100 must first be pulled or slid away from each other longitudinally. To perform this additional operation, a user would typically be required to use two hands or several fingers of the same hand, grasping the first zipper pull tab 100 in a first hand and grasping the second zipper pull tab 200 in the other hand, for example, and sliding them away from each other. At that point, however, the first and second zipper pull tabs 100, 200 remain locked together, in the first interlocked state or configuration 275.

Additional separate and distinct movements are then required to unlock and separate the first and second zipper pull tabs 100, 200 from each other. From the first interlocked state or configuration 275, the gate 120 must be depressed (a second movement) and while depressed, the hook 115 of the first zipper pull tab 100 is removed from around the post 215 and rotated out of the second interior region (or opening) 240 (third and fourth movements). The first and second zipper pull tabs 100, 200 are only then unlocked and uncoupled, with the respective zipper sliders 250 movable by the user.

For this first fastening system embodiment 300, it should be noted that in the interlocked configurations of the first and second zipper pull tabs 100, 200 (both first and second states 278, 280), the base 210 of the second zipper pull tab 200 is positioned or arranged directly above (and on the exterior of) the zipper 265 and, more particularly, directly above and virtually completely covering any opening in the zipper 265 where the opposing zipper teeth 260 may not be engaged to each other.

Second, both the first and second zipper pull tabs 100, 200 lie generally flat against each other and the zipper 265, as illustrated, providing several advantages. For example, the first and second zipper pull tabs 100, 200 are less likely to be caught or snagged on something else and inadvertently unlocked. Also for example, the aesthetics and design of a purse or bag (having the zipper 265) are maintained, as the interlocked first and second zipper pull tabs 100, 200 are comparatively unobtrusive.

Third, the additional thickness of the base 210 of the second zipper pull tab 200 as described above creates additional pressure against the bottom side 103 of the first zipper pull tab 100. This also helps maintain the interlocked configuration of the first and second zipper pull tabs 100, 200 from being disturbed and inadvertently opened.

Fourth, the interlocked configuration of the first and second zipper pull tabs 100, 200 are comparatively tamper-resistant and child-resistant.

Fifth, particularly from the second interlocked state or configuration 280, it requires several separate and distinct movements by the user, often requiring two hands, to uncouple and unlock the first and second zipper pull tabs 100, 200. These two different first and second interlocked states or configurations 275, 280, thereby create significant security and make it difficult for the zipper 265 to be inadvertently opened, or to be otherwise opened without the user being aware of the activity, such as by a thief or pickpocket, for example.

It should be noted that each of the first and second zipper pull tabs 100, 200 (and components, such as a gate 120) may be fabricated, such as machined, molded, printed, stamped, etc., from a wide variety of materials as known or becomes known in the mechanical arts, including coated or uncoated metals or metallic alloys such as aluminum, steel, titanium, carbon steel, nickel, copper, gold, silver, tin, and so on., or any of a variety of compounds such as plastics, polymers or polymeric precursors such as nylon, resins, with or without other embedded components such as carbon fibers, graphene, etc., for example and without limitation. In addition, as mentioned above, the overall size and material selection of the exemplary or representative first and second zipper pull tabs 100, 200, or any of their components, is typically determined based on their application and anticipated stress or weight load, along with aesthetic considerations, such as for a light purse compared to a heavy suitcase, also for example and without limitation.

Figure 21:
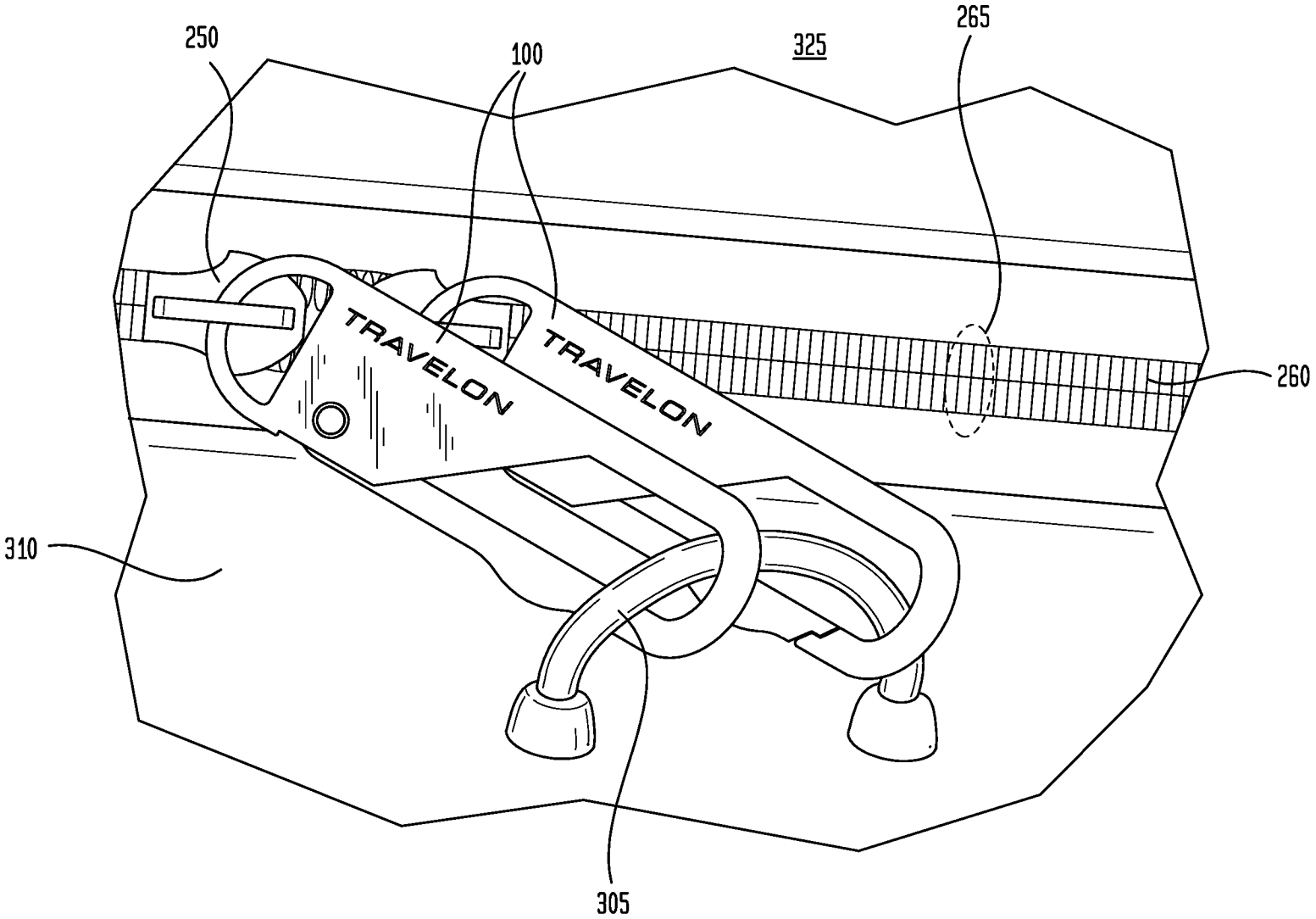
FIG. 21 is a diagram illustrating an isometric view of exemplary or representative first zipper pull tab embodiments and a second fastening system embodiment in a locked configuration.

FIG. 21 is a diagram illustrating an isometric view of exemplary or representative first zipper pull tab 100 embodiments and a second fastening system 325 embodiment in a locked configuration. FIG. 22 is a diagram illustrating an isometric view of an exemplary or representative first zipper pull tab embodiment 100 and a third fastening system 350 embodiment in a locked configuration. FIG. 23 is a diagram illustrating an isometric view of exemplary or representative first zipper pull tab embodiments and a fourth fastening system 375 embodiment in a locked configuration.

In addition to interlocking with the second zipper pull tab 200, the first zipper pull tab 100 may have additional fastening and locking options to create additional fastening system embodiments within the scope of the disclosure. Referring to FIG. 21, two first zipper pull tabs 100 are illustrated, each coupled to a respective zipper slider 250 with a zipper 265 of a carrying bag 310 (only partially shown). As shown, the two first zipper pull tabs 100 have been locked to a C-shaped coupling 305 secured or otherwise attached to the carrying bag 310. This provides significantly added security to the carrying bag 310, as the zippers 265 may not be unzipped (and corresponding compartments or pockets opened) unless and until one or both of the first zipper pull tabs 100 have been unlocked (as described above) from the C-shaped coupling 305. Not separately illustrated the two first zipper pull tabs 100 could also be locked to each other, such as through the respective openings 160 discussed above.

Figure 22:
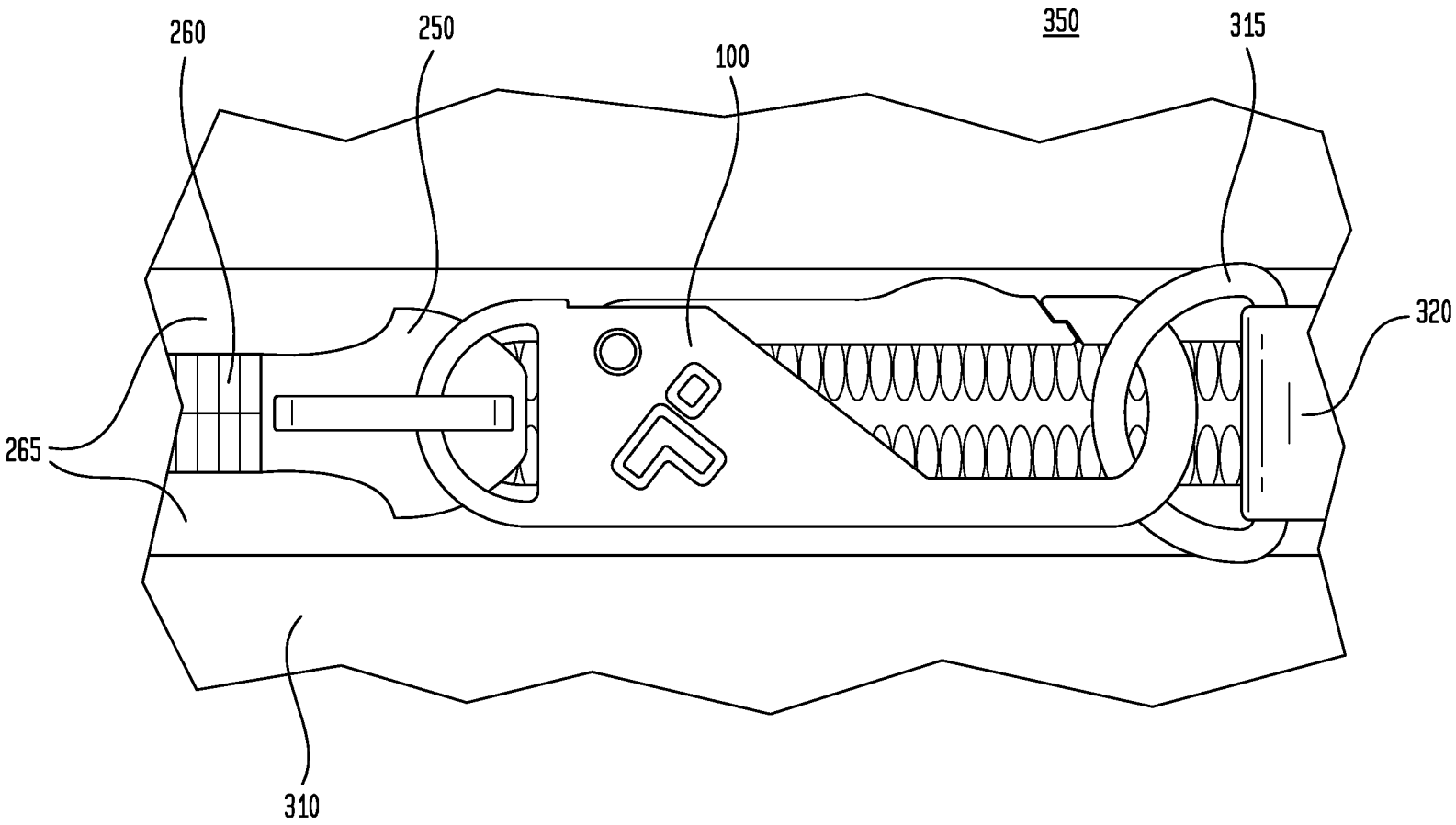
FIG. 22 is a diagram illustrating an isometric view of an exemplary or representative first zipper pull tab embodiment and a third fastening system embodiment in a locked configuration.
Figure 23:
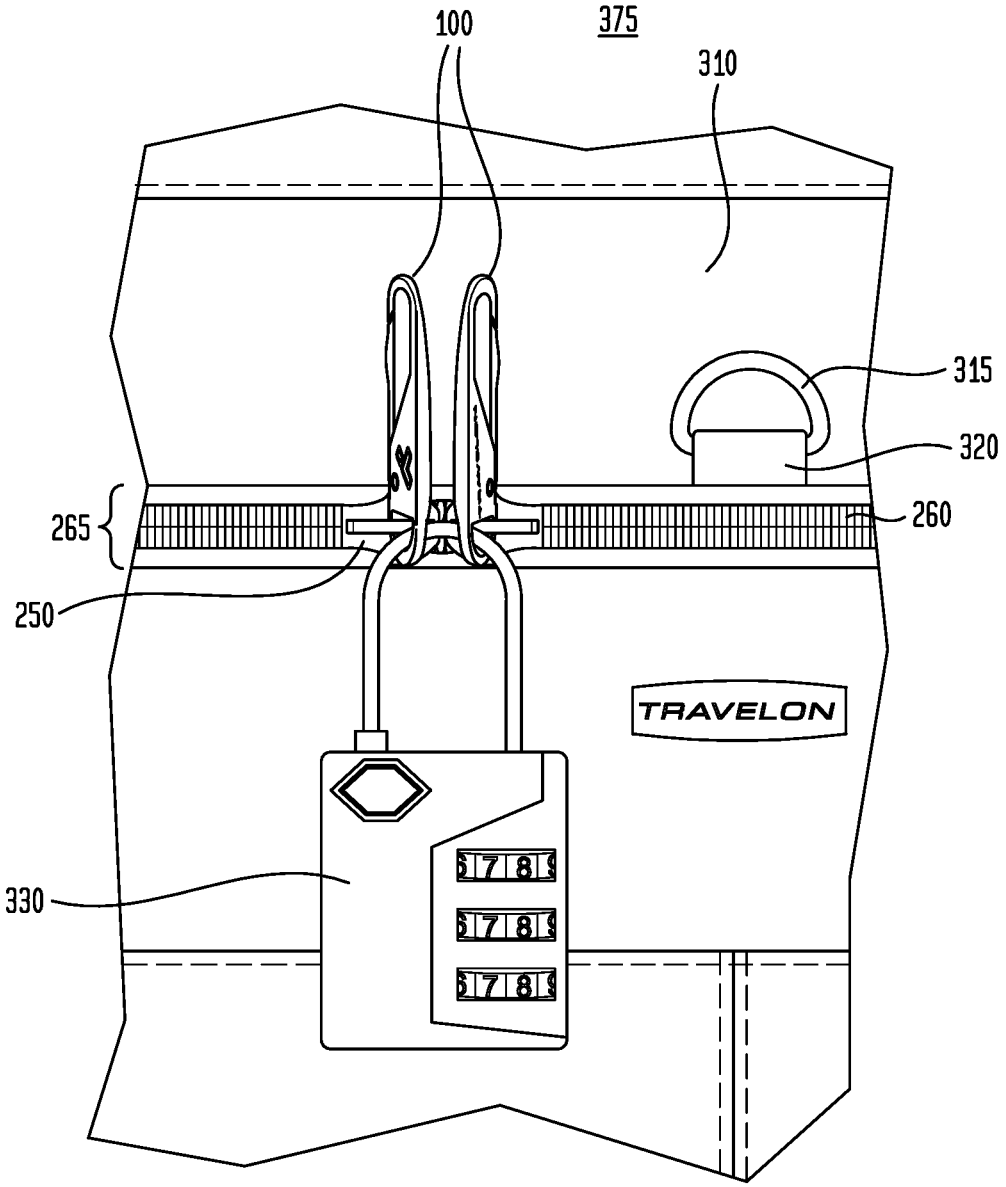
FIG. 23 is a diagram illustrating an isometric view of exemplary or representative first zipper pull tab embodiments and a fourth fastening system embodiment in a locked configuration.
Figure 24A:
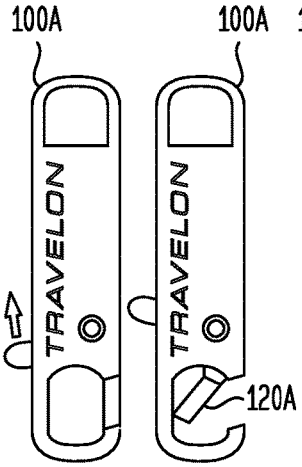
FIGS. 24A, 24B, 24C, 24D, 24E, 24F, 24G, 24H, 24I, 24J, and 24K (collectively referred to herein as "FIG. 24") are diagrams illustrating plan, top views of a plurality of gate closure mechanisms and body and hook configurations for a first zipper pull tab.
Figure 24B:
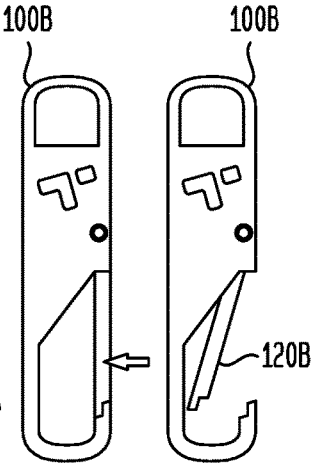
Figure 24C:
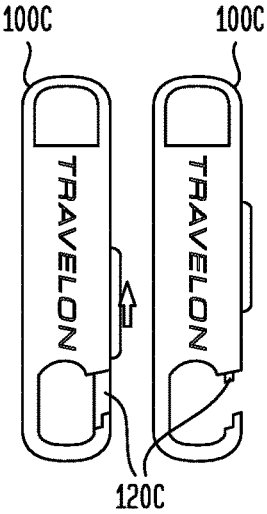
Figure 24D:
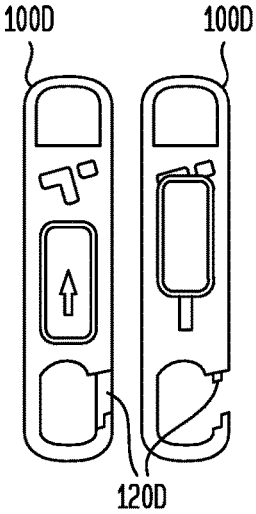
Figure 24E:
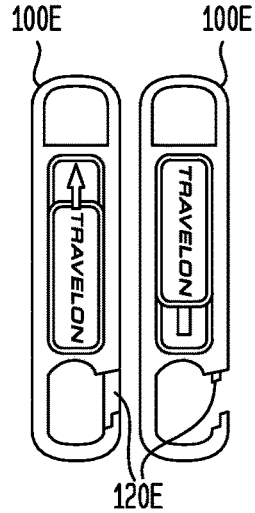
Figure 24F:
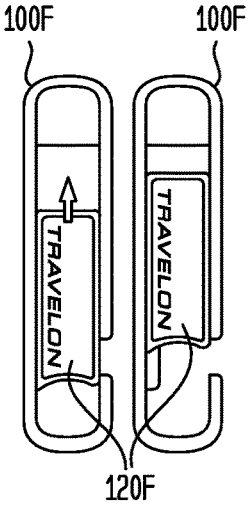
Figure 24G:
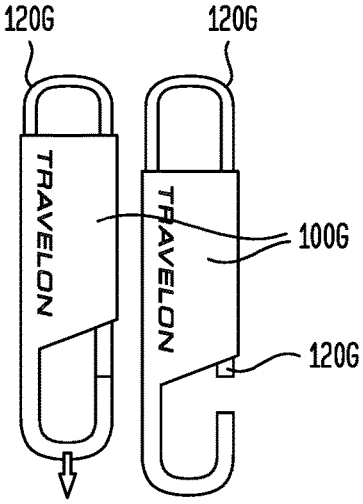
Figure 24H:
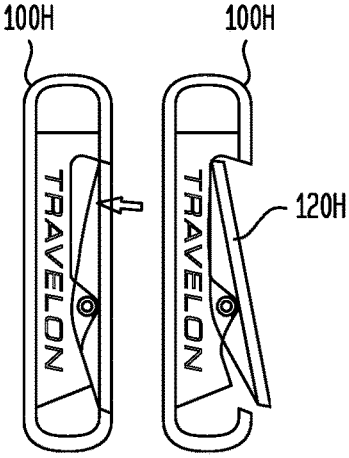
Figure 24I:
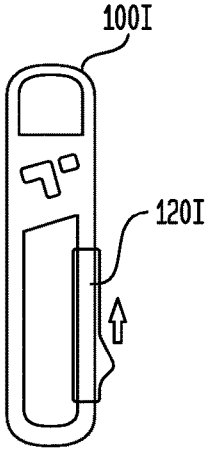
Figure 24J:
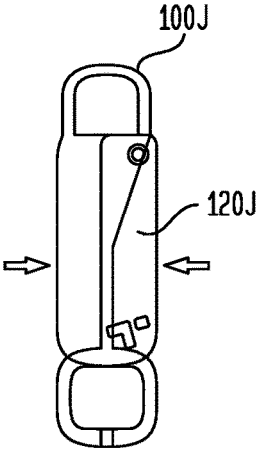
Figure 24K:
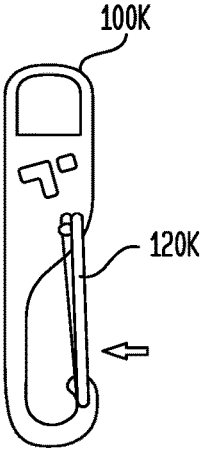
Figure 25L:
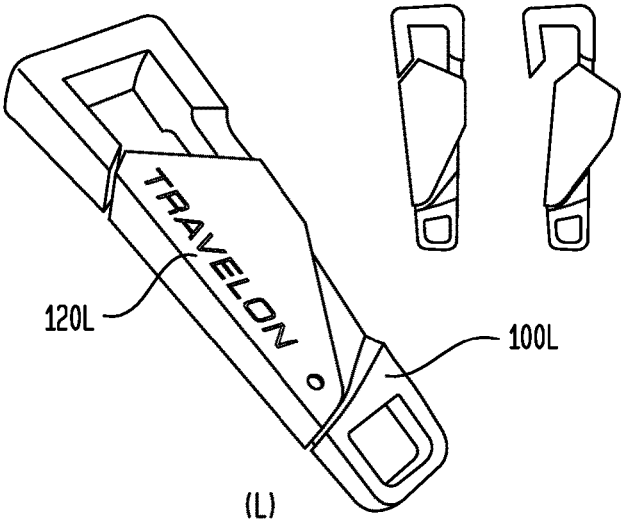
FIGS. 25L, 25M, 25N, and 25P (collectively referred to herein as "FIG. 25") are diagrams illustrating isometric and plan, top views of a plurality of gate closure mechanisms and body and hook configurations for a first zipper pull tab.
Figure 25M:
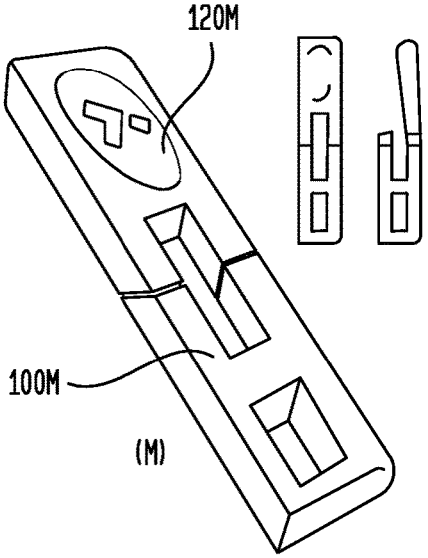
Figure 25N:
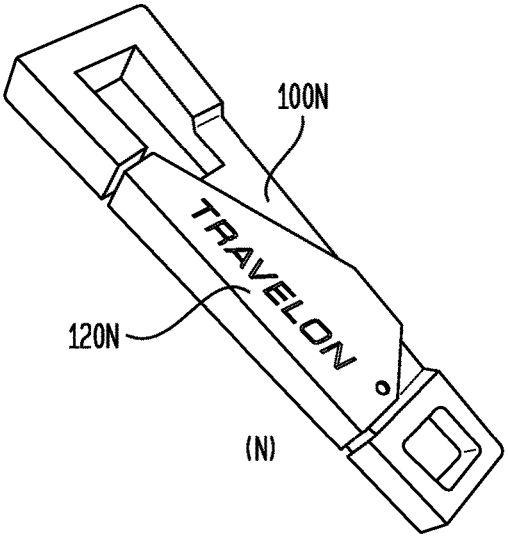
Figure 25P:
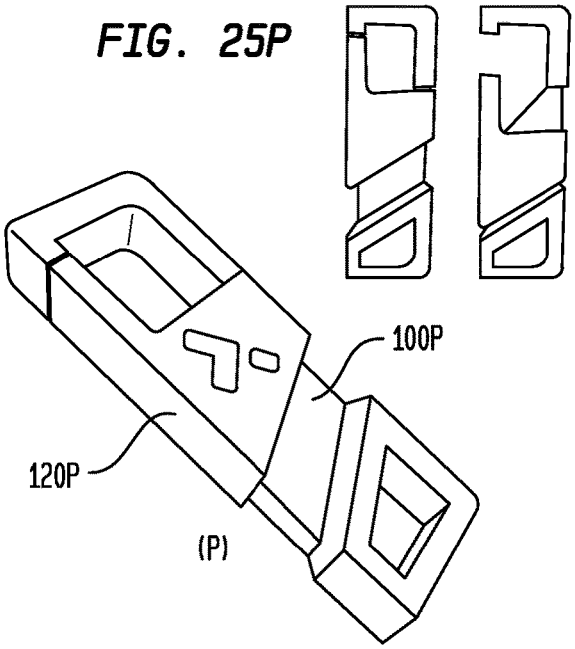
Figure 26Q:
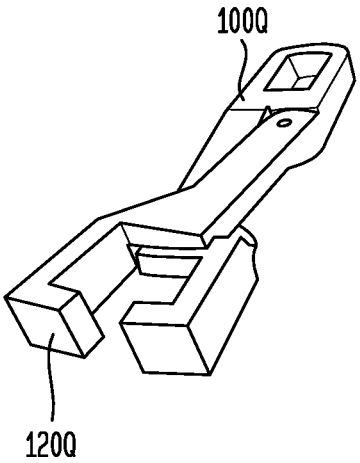
FIGS. 26Q, 26R, 26S and 26T (collectively referred to herein as "FIG. 26") are diagrams illustrating isometric and plan, top views of a plurality of gate closure mechanisms and body and hook configurations for a first zipper pull tab.
Figure 26R:
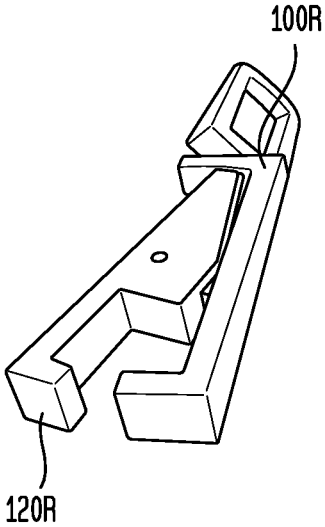
Figure 26S:
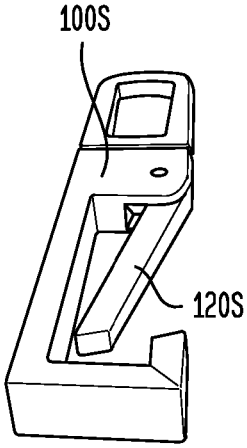
Figure 26T:
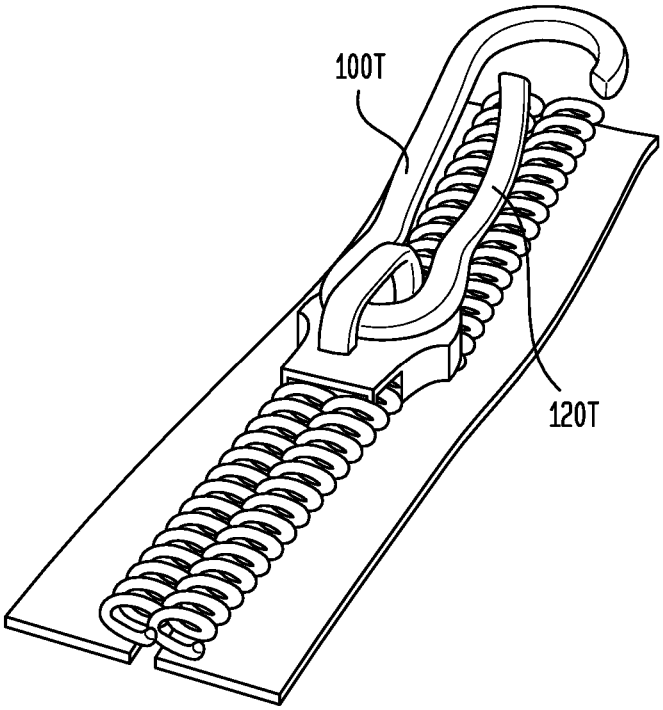
Figure 27A:
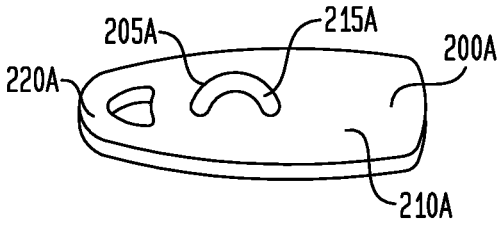
FIGS. 27A, 27B, 27C, and 27D (collectively referred to herein as "FIG. 27") are diagrams illustrating isometric views of a plurality of cover, post and base structures and configurations for a second zipper pull tab.
Figure 27B:
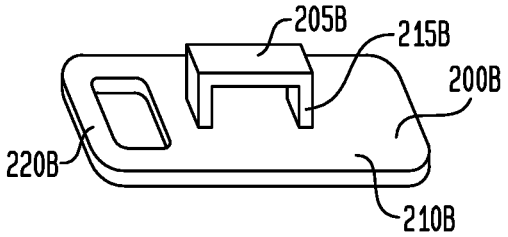
Figure 27C:
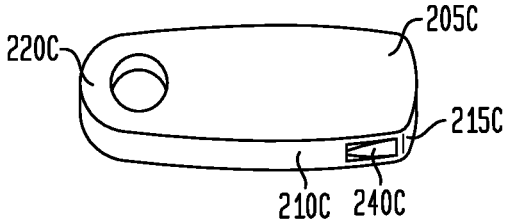
Figure 27D:
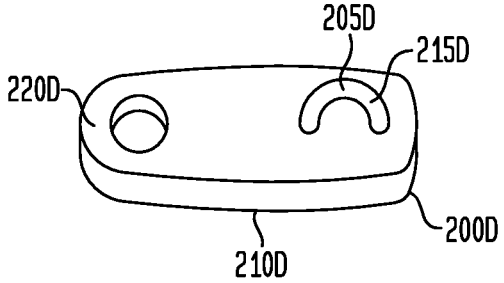

Referring to FIG. 22, a single first zipper pull tab 100 is illustrated, also coupled to a zipper slider 250 with a zipper 265 of a carrying bag 310 (also only partially shown). As shown, the first zipper pull tab 100 has been locked to a D-shaped ring (or coupling) 315 secured or otherwise attached to the carrying bag 310 via loop 320. This also provides significantly added security to the carrying bag 310, as the zipper 265 may not be unzipped (and corresponding compartments or pockets opened) unless and until the first zipper pull tab 100 has been unlocked (as described above) from the D-shaped ring 315.

Referring to FIG. 23, two first zipper pull tabs 100 are also illustrated, each coupled to a respective zipper slider 250 with a zipper 265 of a carrying bag 310 (also only partially shown). Rather than being locked to a C-shaped coupling 305 or a D-shaped ring 315, as shown, the two first zipper pull tabs 100 have been locked to each other, through their respective openings 160, via a lock (or shackle) 330, which may be a combination lock as illustrated or a keyed lock, or both, such as a TSA-compatible lock. For this embodiment, the openings 160 have been sized to allow the insertion of the lock 330. This also provides significantly added security to the carrying bag 310, as the zippers 265 may not be unzipped (and corresponding compartments or pockets opened) unless and until one or both of the first zipper pull tabs 100 have been unlocked (as described above) from the lock 330. Not separately illustrated the two first zipper pull tabs 100 could also be locked to the D-shaped ring 315 and further locked using lock 330 through the respective openings 160 as discussed above.

As discussed above, in addition to the design and configuration of the first zipper pull tab 100, many more designs and configurations are available and within the scope of the present disclosure. FIGS. 24-26 are diagrams illustrating many, but far from all, equivalent gate 120 closure mechanisms and body and hook shapes and configurations for a first zipper pull tab 100. For example and without limitation, first zipper pull tab 100A has another body and hook configuration with a pull tab configuration for a gate 120A; first zipper pull tab 100B has another body and hook configuration with a push configuration for a gate 120B, similar to gate 120; first zipper pull tab 100C has another body and hook configuration with a side sliding configuration for a gate 120C; first zipper pull tab 100D has another body and hook configuration with a face sliding configuration for a gate 120D; first zipper pull tab 100E has another body and hook configuration with a inset face sliding configuration for a gate 120E; first zipper pull tab 100F has another body and hook configuration with a face slide configuration forming a gate 120F; first zipper pull tab 100G has another body and hook configuration with a body and hook slide configuration on a gate 120G; first zipper pull tab 100H has another body and hook configuration with a side lever configuration for a gate 120H; first zipper pull tab 100I has another body and hook configuration with a sliding configuration for a gate 120I; first zipper pull tab 100J has another body and hook configuration with a side pinching or squeezing configuration for a clip-style gate 120J; first zipper pull tab 100D has another body and hook configuration with a push configuration for a carabiner-style gate 120K; first zipper pull tab 100L has another body and hook configuration with a push configuration for a gate 120L; first zipper pull tab 100M has another body and hook configuration with a pull cap configuration for a gate 120M; first zipper pull tab 100N has another body and hook configuration with a push configuration for a gate 120N; first zipper pull tab 100P has another body and hook configuration with a slide configuration for a gate 120P; first zipper pull tab 100Q has another body and hook configuration with a pull tab configuration for a gate 120Q; first zipper pull tab 100R has another body and hook configuration with a pull tab configuration for a gate 120R; first zipper pull tab 100S has another body and hook configuration with a pull tab configuration for a gate 120S; and first zipper pull tab 100T has another body and hook configuration with a pull tab configuration for a gate 120T. Those having skill in the art will recognize that all such configurations may be utilized equivalently to the gate 120 and body and hook configurations for a first zipper pull tab 100.

It should be noted that these additional gate 120A-120T closure mechanisms and body and hook shapes and configurations for a first zipper pull tab 100A-100T are all able to function and work with the second zipper pull tab 200 to have interlocked first and second zipper pull tabs 100, 200 as described above. In addition, these additional gate 120A-120T closure mechanisms and body and hook shapes and configurations for a first zipper pull tab 100A-100T are all able to function and work with any and all of the equivalent variations of the second zipper pull tab 200 described herein to have interlocked first and second zipper pull tabs 100, 200.

As discussed above, in addition to the design and configuration of the second zipper pull tab 200, many more designs and configurations are available and within the scope of the present disclosure. FIG. 27 are diagrams illustrating isometric views of many, but far from all, equivalent cover and post mechanisms and base configurations for a second zipper pull tab 200. For example and without limitation, second zipper pull tab 200A has another configuration which effectively combines the functionality of a cover 205 and post 215 to have a continuous cover 205A and post 215A which together have the appearance of a single C-shaped coupling for locking with a first zipper pull tab 100; second zipper pull tab 200B has another configuration which effectively combines the functionality of a cover 205 and post 215 to have a continuous cover 205B and post 215B which together have the appearance of a rectangular-shaped coupling for locking with a first zipper pull tab 100; second zipper pull tab 200C has another configuration which effectively rearranges and relocates a cover 205 and post 215 to the distal end of the base 210 to have a distally-located post 215C for locking with a first zipper pull tab 100; and second zipper pull tab 200D has another configuration which effectively combines the functionality of a cover 205 and post 215 to have a continuous cover 205D and post 215D at the distal end of the base 210D which together have the appearance of a single, distally-located C-shaped coupling for locking with a first zipper pull tab 100.

It should be noted that these additional post 215A-215D mechanisms and cover and base shapes and configurations for a second zipper pull tab 200A-200D are all able to function and work with the first zipper pull tab 100 to have interlocked first and second zipper pull tabs 100, 200 as described above. In addition, these additional post 215A-215D mechanisms and cover and base shapes and configurations for a second zipper pull tab 200A-200D are all able to function and work with any and all of the equivalent variations of the first zipper pull tab 100 described above to have interlocked first and second zipper pull tabs 100, 200.

Several unique features and advantages of the various embodiments of the present disclosure are readily apparent. The exemplary embodiments provide for increased security of a fastener, requiring several different and distinct movements to open and unlock the exemplary or representative first and second zipper pull tabs 100, 200 from each other. This also serves to decrease the concerns of a traveler or commuter, for example, knowing that a would-be pickpocket or other thief cannot quickly and surreptitiously undo and open the fasteners, such as to quickly steal contents from a zippered pocket or compartment of a purse, briefcase, shoulder bag or other carrying bag. The exemplary or representative first and second zipper pull tabs 100, 200 may also be implemented aesthetically, with designs which do not look or feel utilitarian but which nonetheless have superior attachment and security functionality.

The present disclosure is to be considered as an exemplification of the principles of the invention and is not intended to limit the invention to the specific embodiments illustrated. In this respect, it is to be understood that the invention is not limited in its application to the details of construction and to the arrangements of components set forth above and below, illustrated in the drawings, or as described in the examples. Systems, methods and apparatuses consistent with the present invention are capable of other embodiments and of being practiced and carried out in various ways.

Although the invention has been described with respect to specific embodiments thereof, these embodiments are merely illustrative and not restrictive of the invention. In the description herein, numerous specific details are provided, such as examples of structural connections, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. In addition, the various Figures are not drawn to scale and should not be regarded as limiting.

Reference throughout this specification to "one embodiment", "an embodiment", or a specific "embodiment" means that a particular feature, structure, or characteristic described in connection with the embodiment is included in at least one embodiment of the present invention and not necessarily in all embodiments, and further, are not necessarily referring to the same embodiment. Furthermore, the particular features, structures, or characteristics of any specific embodiment of the present invention may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the invention, particularly for embodiments in which a separation or combination of discrete components is unclear or indiscernible. In addition, use of the term "coupled" herein, including in its various forms such as "coupling" or "couplable", means and includes any direct or indirect electrical, structural or magnetic coupling, connection or attachment, or adaptation or capability for such a direct or indirect electrical, structural or magnetic coupling, connection or attachment, including integrally formed components and components which are coupled via or through another component.

Furthermore, any signal arrows in the drawings/Figures should be considered only exemplary, and not limiting, unless otherwise specifically noted. Combinations of components of steps will also be considered within the scope of the present invention, particularly where the ability to separate or combine is unclear or foreseeable. The disjunctive term "or", as used herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" include plural references unless the context clearly dictates otherwise. Also as used in the description herein and throughout the claims that follow, the meaning of "in" includes "in" and "on" unless the context clearly dictates otherwise.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated, for example and without limitation. In addition, every intervening sub-range within range is contemplated, in any combination, and is within the scope of the disclosure. For example, for the range of 5-10, the sub-ranges 5-6, 5-7, 5-8, 5-9, 6-7, 6-8, 6-9, 6-10, 7-8, 7-9, 7-10, 8-9, 8-10, and 9-10 are contemplated and within the scope of the disclosed range, also for example and without limitation.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

The invention claimed is:

1. A zipper pull tab coupleable to a zipper slider for a zipper, the zipper pull tab comprising:

a base having a first side and a second side opposite the first side, the base comprising a first recess extending into the base from the second side, wherein the base is flat and has a first thickness;

a bias spring arranged in the first recess;

a first, pivot coupling coupled to the base and extending through the first recess;

a hook integrally formed with and extending from the base on the second side, the hook comprising an elongated rectilinear portion coplanar with the base and a C-shaped curvature coplanar with the base and terminating in a hook end;

a movable gate having a first gate end and a second gate end, the second gate end arranged at least partially inside the first recess, the movable gate extending from the first recess coplanar with the hook and the base and parallel to the elongated rectilinear portion of the hook, the movable gate coupled inside the first recess to the bias spring, the second gate end pivotably coupled inside the first recess to the pivot coupling, the movable gate and hook forming a first interior region of the zipper pull tab, the movable gate pivotable into the first recess and the first interior region; and a second, C-shaped coupling integrally formed with and extending from the first side of the base for coupling to the zipper slider, the second C-shaped coupling having a thickness tapering from the first thickness at the first side of the base to a second thickness at a first end of the zipper pull tab, the first thickness greater than the second thickness.

2. The zipper pull tab of claim 1, wherein at least one of the hook end and first gate end further comprises a protruding tab structure and at least one of the first gate end and hook end respectively further comprises a second, mating recess.

3. The zipper pull tab of claim 1, wherein in a closed configuration, the movable gate extends parallel to the elongated rectilinear portion of the hook.

4. The zipper pull tab of claim 1, wherein the coplanar elongated rectilinear portion and a C-shaped curvature of the hook are insertable into a second interior region of another, second zipper pull tab.

5. The zipper pull tab of claim 1, wherein the C-shaped curvature of the hook is insertable into a third coupling attached to a carrying bag.

6. The zipper pull tab of claim 1, wherein the elongated rectilinear portion of the hook extends perpendicular to the first side of the base.

7. The zipper pull tab of claim 1, wherein a ratio of the first thickness to the second thickness is between 4:1 to 2:1.

8. The zipper pull tab of claim 1 wherein the hook has a thickness tapering from the first thickness at the second side of the base to a third thickness at a second end of the zipper pull tab, the first thickness greater than the third thickness.

9. The zipper pull tab of claim 8, wherein a ratio of the first thickness to the third thickness is between 4:1 to 2:1.

10. The zipper pull tab of claim 1, further comprising:

a grip integrally formed with the movable gate, the grip spaced apart from the first gate end and extending transversely from the movable gate opposite from the first interior region.

11. The zipper pull tab of claim 1, wherein each of the hook end and the first gate end further comprise a plurality of mating faces extending transversely, longitudinally, or both transversely and longitudinally.

12. A zipper pull tab coupleable to a zipper slider for a zipper of a carrying bag, the zipper pull tab comprising:

a flat base having a first thickness, the base having a first side and a second side opposite the first side, the base comprising a first recess extending into the base from the second side;

a bias spring arranged in the first recess;

a first, pivot coupling coupled to the base and extending through the first recess;

a hook integrally formed with and extending from the second side of the base, the hook comprising an elongated rectilinear portion coplanar with the base and a C-shaped curvature coplanar with the base and terminating in a hook end;

a movable gate having a first gate end and a second gate end, the second gate end arranged at least partially inside the first recess, the movable gate coupled inside the first recess to the bias spring, the second gate end pivotably coupled inside the first recess to the pivot coupling, the movable gate extending from the first recess coplanar with the hook and base, the movable and the hook forming a first interior region of the zipper pull tab, the movable gate pivotable into the first recess and the first interior region;

a second, C-shaped coupling integrally formed with and extending from the first side of the base for coupling to the zipper slider, the second C-shaped coupling having a thickness tapering from the first thickness at the first side of the base to a second thickness at a first end of the zipper pull tab, the first thickness greater than the second thickness; and a grip integrally formed with the movable gate, the grip spaced apart from the first gate end and extending transversely from the movable gate opposite from the first interior region.

13. The zipper pull tab of claim 12, wherein at least one of the hook end and first gate end further comprises a protruding tab structure and at least one of the first gate end and hook end respectively further comprises a second, mating recess.

14. The zipper pull tab of claim 12, wherein the C-shaped curvature of the hook is insertable into a third coupling attached to the carrying bag.

15. The zipper pull tab of claim 12, wherein in a closed configuration, the movable gate extends parallel to the elongated rectilinear portion of the hook.

16. The zipper pull tab of claim 12, wherein the elongated rectilinear portion of the hook extends perpendicular to the first side of the base.

17. The zipper pull tab of claim 12, wherein a ratio of the first thickness to the second thickness is between 4:1 to 2:1.

18. The zipper pull tab of claim 12, wherein the hook has a thickness tapering from the first thickness at the second side of the base to a third thickness at a second end of the zipper pull tab, the first thickness greater than the third thickness, wherein a ratio of the first thickness to the third thickness is between 4:1 to 2:1.

19. The zipper pull tab of claim 12, wherein each of the hook end and the first gate end comprise a plurality of mating faces extending transversely, longitudinally, or both transversely and longitudinally.

20. A zipper pull tab coupleable to a zipper slider for a zipper, the zipper pull tab comprising:

a flat base having a first thickness, the base having a first side and a second side opposite the first side, the base comprising a first recess extending into the base from the second side;

a bias spring arranged in the first recess;

a first, pivot coupling coupled to the base and extending through the first recess;

a second, C-shaped coupling integrally formed with and extending from the first side of the base for coupling to the zipper slider, wherein the C-shaped coupling has a thickness tapering linearly from the first thickness at the first side of the base to a second thickness at an end of the zipper pull tab, the first thickness greater than the second thickness;

a hook integrally formed with and extending from the base, the hook coplanar with the base and comprising an elongated rectilinear portion and a C-shaped curvature terminating in a hook end, the elongated rectilinear portion extending perpendicular to the first side of the base; and a movable gate having a first gate end and a second gate end, the second gate end arranged at least partially inside the first recess, the movable gate extending from the first recess coplanar with the hook and the base and parallel to the elongated rectilinear portion of the hook, the movable gate coupled inside the first recess to the bias spring, the second gate end pivotably coupled inside the first recess to the pivot coupling, the movable gate and hook forming a first interior region of the zipper pull tab, and the movable gate pivotable transversely into the first recess and the first interior region;

wherein each of the hook end and the first gate end further comprise a plurality of mating faces extending transversely, longitudinally, or both transversely and longitudinally, and wherein at least one of the hook end and first gate end further comprises a protruding tab structure and at least one of the first gate end and hook end respectively further comprises a second, mating recess.

* * * * *